United States Patent [19]

Sakashita

[11] Patent Number: 5,014,586

[45] Date of Patent: May 14, 1991

[54] CHORD SETTING APPARATUS AND ELECTRONIC WIND INSTRUMENT USING THE SAME

[75] Inventor: Shigeo Sakashita, Hamura, Japan

[73] Assignee: Casio Computer Co., Ltd., Tokyo, Japan

[21] Appl. No.: 364,010

[22] Filed: Jun. 9, 1989

[30] Foreign Application Priority Data

Jun. 17, 1988 [JP] Japan ..... 63-80183[U]
Dec. 2, 1988 [JP] Japan ..... 63-305722

[51] Int. Cl.[5] ..... G10H 1/38
[52] U.S. Cl. ..... 84/637; 84/DIG. 22
[58] Field of Search ..... 84/637, 669, 715, 723, 84/725, 730, 732, 733, 734, DIG. 22

[56] References Cited

U.S. PATENT DOCUMENTS 4,381,689 5/1983 Oya ..... 84/DIG. 22 X
4,397,209 8/1983 Deforeit ..... 84/DIG. 22 X
4,472,992 9/1984 Okuma et al. ..... 84/637

*Primary Examiner*—W. B. Perkey
*Attorney, Agent, or Firm*—Frishauf, Holtz, Goodman & Woodward

[57] ABSTRACT

An apparatus disclosed designates pitches based on combinations of operated statuses of a plurality of pitch designating switches and sets a chord whose type is designated by type designating switches and whose root is the designated pitch.

31 Claims, 18 Drawing Sheets

| PITCH | PITCH DATA (INTERNAL CODE VALUE) |
|---|---|
| B1 | 35 |
| C2 | 36 |
| C2# | 37 |
| D2 | 38 |
| E2b | 39 |
| E2 | 40 |
| F2 | 41 |
| F2# | 42 |
| G2 | 43 |
| A2b | 44 |
| A2 | 45 |
| B2b | 46 |
| B2 | 47 |
| C3 | 48 |
| | |
| C4 | 60 |
| C4# | 61 |
| D4 | 62 |
| E4b | 63 |
| E4 | 64 |
| F4 | 65 |
| F4# | 66 |
| G4 | 67 |
| A4b | 68 |
| A4 | 69 |
| B4b | 70 |
| B4 | 71 |
| | |
| F6 | 77 |
| F6# | 78 |
| G6 | 79 |
| A6b | 80 |
| A6 | 81 |
| B6b | 82 |
| B6 | 83 |
| C7 | 84 |

FIG. 2

| BIT7(MSB) | BIT6 | BIT5 | BIT4 | BIT3 | BIT2 | BIT1(LSB) |
|---|---|---|---|---|---|---|
| STATUS OF SWTCH 2g | STATUS OF SWITCH 2f | STATUS OF SWITCH 2e | STATUS OF SWITCH 2d | STATUS OF SWITCH 2c | STATUS OF SWITCH 2b | STATUS OF SWITCH 2a |

FIG. 3A

| | CONTENTS OF R REGISTER | | | | | | | CORRESPONDING CHORD NAME IN CHORD MODE 2 |
|---|---|---|---|---|---|---|---|---|
| | 7(MSB) | 6 | 5 | 4 | 3 | 2 | 1(LSB) | |
| 20-1 | 0 | 0 | 0 | 0 | 0 | 0 | 1 | C MAJOR |
| 20-2 | 0 | 0 | 0 | 0 | 0 | 1 | 0 | D MAJOR |
| 20-3 | 0 | 0 | 0 | 0 | 0 | 1 | 1 | C MINOR |
| 20-4 | 0 | 0 | 0 | 0 | 1 | 0 | 0 | E MAJOR |
| 20-5 | 0 | 0 | 0 | 0 | 1 | 0 | 1 | E MINOR |
| 20-6 | 0 | 0 | 0 | 0 | 1 | 1 | 0 | D MINOR |
| 20-7 | 0 | 0 | 0 | 0 | 1 | 1 | 1 | C MAJOR 7th |
| 20-8 | 0 | 0 | 0 | 1 | 0 | 0 | 0 | F MAJOR |
| 20-9 | 0 | 0 | 0 | 1 | 0 | 0 | 1 | F MINOR |
| 20-10 | 0 | 0 | 0 | 1 | 0 | 1 | 0 | F MINOR |

FIG. 3B

| CONTENTS OF R REGISTER | | | | | | | PITCH DATA OF MUSICAL TONE | |
|---|---|---|---|---|---|---|---|---|
| MSB(7) | 6 | 5 | 4 | 3 | 2 | LSB(1) | PITCH NAME | INTERNAL CODE VALUE |
| 1 | 1 | 1 | 1 | 1 | 1 | 1 | $C_4$ | 60 |
| 1 | 1 | 1 | 1 | 1 | 1 | 0 | $D_4$ | 62 |
| 1 | 1 | 1 | 1 | 1 | 0 | 0 | $E_4$ | 64 |
| 1 | 1 | 1 | 1 | 0 | 0 | 0 | $F_4$ | 65 |
| 1 | 1 | 1 | 0 | 0 | 0 | 0 | $G_4$ | 67 |
| 1 | 1 | 0 | 0 | 0 | 0 | 0 | $A_4$ | 69 |
| 1 | 0 | 0 | 0 | 0 | 0 | 0 | $B_4$ | 71 |

FIG. 4

| | CHORD DATA | CHORD | | | | |
|---|---|---|---|---|---|---|
| | | ROOT | 3rd | 5th | 7th | CHORD NAME |
| 30 | 36 | C4 | E4 | G4# | | Caug |
| | ≈ | ≈ | ≈ | ≈ | ≈ | ≈ |
| 30 | 60 | C4 | E4 | G4 | | C MAJOR |
| 30 | 62 | D4 | F4# | A4 | | D MAJOR |
| | ≈ | ≈ | ≈ | ≈ | ≈ | ≈ |
| 30 | 95 | B | D# | F# | G# | Bm7 |
| | 30-1 | 30-2 | | | | |

FIG. 5

| ADDRESS | CHORD CONSTITUENTS | | | | CHORD NAME |
|---|---|---|---|---|---|
| | ROOT | 3rd | 5th | 7th | |
| 1 | $C_4$ | $E_4$ | $G_4$ | | C MAJOR |
| 2 | $D_4$ | $F_4^{\#}$ | $A_4$ | | D MAJOR |
| 3 | $C_4$ | $E^b{}_4$ | $G_4$ | | C MINOR |
| 4 | $E_4$ | $G_4^{\#}$ | $B_4$ | | E MAJOR |
| 5 | $E_4$ | $G_4$ | $B_4$ | | E MINOR |
| 6 | $D_4$ | $F_4$ | $A_4$ | | D MINOR |
| 7 | $C_4$ | $E_4$ | $G_4$ | $B^b{}_4$ | C MAJOR 7th |
| 8 | $F_4$ | $A_4$ | $C_5$ | | F MAJOR |
| | | | | | |
| 10 | $F_4$ | $A^b{}_4$ | $C_5$ | | F MINOR |
| | | | | | |
| 13 | $F_4$ | $A_4$ | $C_5$ | $E_5$ | F MAJOR 7th |
| | | | | | |
| 16 | $G_4$ | $B_4$ | $D_5$ | | G MAJOR |
| | | | | | |
| 32 | $A_4$ | $C_6^{\#}$ | $A_6$ | | A MAJOR |
| | | | | | |
| 64 | $B_5$ | $D_5^{\#}$ | $F_5^{\#}$ | | B MAJOR |
| | | | | | |
| 127 | – | – | – | – | – |

FIG. 6

CHORD SETTING APPARATUS AND ELECTRONIC WIND INSTRUMENT USING THE SAME

BACKGROUND OF THE INVENTION

1. Field of the Invention

The present invention relates to a chord setting apparatus and an electronic wind instrument which produces a musical tone associated with a chord set by this apparatus.

2. Description of the Related Art

There is known a so-called electronic wind instrument which has pitch designating switches located where a player can easily touch them and with which the player designates a single pitch (note) through a single operation by a combination of how to press these switches and plays a music with a musical tone at the designated pitch.

According to this type of electronic wind instrument, however, unlike electronic keyboard instruments or electronic stringed instruments, pitches are assigned to different combinations of the pitch designating switches in operation, not in one-to-one correspondence to the switches. It is not therefore possible to designate a plurality of pitches simultaneously.

Because of the above, electronic wind instruments are generally considered capable of giving only singletone initiated musical performance and a chord performance using the instruments is hardly thought of.

Typical electronic wind instruments have around ten pitch designating switches which include seven switches corresponding to pitches of notes C to B and two for designating sharp (#) and flat (b). Unlike electronic keyboard instruments and electronic stringed instruments having many pitch designating switches, therefore, the electronic wind instruments may designate major chords at the best if need be and cannot be expected to ensure easy designation of different chords such as minor and seventh chords.

With the use of such an electronic wind instrument which has fewer pitch designating switches and generally designates pitches by combinations of these switches in operation, there hardly exists a method available or proposed for playing a music with many chords including not only major chords but also different types of chords such as minor and seventh chords. The only method, it seems, is to program in advance pitch differences with respect to roots designated by the pitch designating switches and generate a chord sound when actually playing a music, by automatically preparing a root designated by operation of the pitch designating switches and musical tones based on the pitch difference data programmed with respect to the designated root. (Refer to the manuals of YAMAHA WX-7 and WX-11 and AKAI EWV2000.)

With the use of the above method for setting a chord according to the mentioned program system, however, it is necessary to provide a switch or switches to enter pitch differences, a display unit for displaying input data at the time of programming and a memory for storing the entered pitch difference data. This would inevitably increase the manufacturing cost and require a troublesome operation for executing the programming.

In addition, when power is turned off, the set pitch difference data will be erased and should be programmed again. This is very inconvenient. To back up the memory as one solution, it is necessary to provide a power unit for memory backup, thus increasing the cost. Due to a small mounting space in or on the electronic wind instrument body, the memory backup unit should be externally mounted. This is disadvantageous for the portability of the instrument and will get in the way of playing a music.

SUMMARY OF THE INVENTION

Accordingly, it is an object of this invention to provide a chord setting apparatus particularly effective for use in an electronic wind instrument, which has fewer number of pitch designating switches and normally designates a pitch by a combination of operated pitch designating switches, and an electronic wind instrument which facilitates the setting of a chord using this chord setting apparatus.

According to one aspect of this invention, there is provided a chord setting apparatus comprising:

pitch designating means for designating only one pitch from among pitches in at least one octave range based on a combination of operational statuses of a plurality of pitch designating actuators;

type designating means for designating a type of a chord; and chord setting means for setting a chord of a type designated by the type designating means, with a root being a pitch designated by the pitch designating means.

According to a different aspect of this invention, there is provided an electronic wind instrument comprising:

pitch designating means for designating only one pitch from among pitches in at least one octave range based on a combination of operational statuses of a plurality of pitch designating actuators;

type designating means for designating a type of a chord;

chord setting means for setting a chord of a type designated by the type designating means, with a root being a pitch designated by the pitch designating means; and tone generating means for generating a musical tone associated with the chord set by the chord setting means.

According to another aspect of this invention, there is provided a chord setting apparatus comprising:

a plurality of pitch designating actuators respectively assigned with pitches in at least one octave range;

quantity detecting means for, upon operation of the pitch designating actuators, detecting a number of the pitch designating actuators simultaneously operated;

type designating means for designating a type of a chord in accordance with a detection result of the quantity detecting means; and chord setting means for, upon operation of one of the pitch designating actuators, setting a chord of the type designated by the type designating means, with a root being a pitch assigned to the operated pitch designating actuator, and for, upon simultaneous operation of two or more of the pitch designating actuators, setting a chord of the type designated by the type designating means, with a root being a highest or lowest one of those pitches assigned to the operated two or more pitch designating actuators.

According to a still another aspect of this invention, there is provided an electronic wind instrument comprising:

a plurality of pitch designating actuators respectively assigned with pitches in at least one octave range;

quantity detecting means for, upon operation of the pitch designating actuators, detecting a number of the pitch designating actuators simultaneously operated;

type designating means for designating a type of a chord in accordance with a detection result of the quantity detecting means;

chord setting means for, upon operation of one of the pitch designating actuators, setting a chord of the type designated by the type designating means, with a root being a pitch assigned to the operated pitch designating actuator, and for, upon simultaneous operation of two or more of the pitch designating actuators, setting a chord of the type designated by the type designating means, with a root being a highest or lowest one of those pitches assigned to the operated two or more pitch designating actuators;

command means for detecting a strength of a breath operation and giving a command to generate a musical tone associated with the chord set by the chord setting means when the strength of the breath operation becomes equal to or greater than a predetermined level; and tone generating means for generating a musical tone in accordance with the command from the command means.

According to a further aspect of this invention, there is provided a chord setting apparatus comprising:

a plurality of pitch designating actuators respectively assigned with pitches in at least one octave range;

quantity detecting means for, upon operation of the pitch designating actuators, detecting a number of the pitch designating actuators simultaneously operated;

type designating means for designating a type of a chord in accordance with a detection result of the quantity detecting means; and chord setting means for, upon operation of one of the pitch designating actuators, setting a chord of the type designated by the type designating means, with a root being a pitch assigned to the operated pitch designating actuator, and for, upon simultaneous operation of two or more of the pitch designating actuators, discriminating whether or not those pitches which are assigned to the operated two or more pitch designating actuators have a non-continuous pitch relation, setting a chord of the type designated by the type designating means, with a root being a highest or lowest one of those pitches assigned to the operated two or more pitch designating actuators when it is discriminated that there exists the non-continuous pitch relation, and setting a chord of the type designated by the type designating means when it is not discriminated that the non-continuous relation exists, with a root being that of the highest and lowest pitches which differs from the one taken as the root in a case of where it is discriminated that the non-continuous relation exists.

According to a still further aspect of this invention, there is provided an electronic wind instrument comprising:

a plurality of pitch designating actuators respectively assigned with pitches in at least one octave range;

quantity detecting means for, upon operation of the pitch designating actuators, detecting a number of the pitch designating actuators simultaneously operated;

type designating means for designating a type of a chord in accordance with a detection result of the quantity detecting means;

chord setting means for, upon operation of one of the pitch designating actuators, setting a chord of the type designated by the type designating means, with a root being a pitch assigned to the operated pitch designating actuator, and for, upon simultaneous operation of two or more of the pitch designating actuators, discriminating whether or not those pitches which are assigned to the operated two or more pitch designating actuators have a non-continuous pitch relation, setting a chord of the type designated by the type designating means, with a root being a highest or lowest one of those pitches assigned to the operated two or more pitch designating actuators when it is discriminated that there exists the non-continuous pitch relation, and setting a chord of the type designated by the type designating means when it is not discriminated that the non-continuous relation exists, with a root being that of the highest and lowest pitches which differs from the one taken as the root in a case of where it is discriminated that the non-continuous relation exists; and tone generating means for generating a musical tone associated with the chord set by the chord setting means.

BRIEF DESCRIPTION OF THE DRAWINGS

FIG. 2 is a diagram illustrating pitch data (internal chord values);

FIGS. 3A and 3B are diagrams illustrating the internal configuration of an R register;

FIG. 4 is a diagram illustrating the internal structure of a single tone conversion table;

FIG. 5 is a diagram illustrating the internal structure of the first chord conversion table;

FIG. 6 is a diagram illustrating the internal structure of the second chord conversion table;

FIGS. 9A through 9F are diagrams for explaining how to set chords in chord mode 2;

DETAILED DESCRIPTION OF THE PREFERRED EMBODIMENT

A preferred embodiment of this invention will now be described referring to the accompanying drawings.

ARRANGEMENT OF EMBODIMENT

Figure 1:
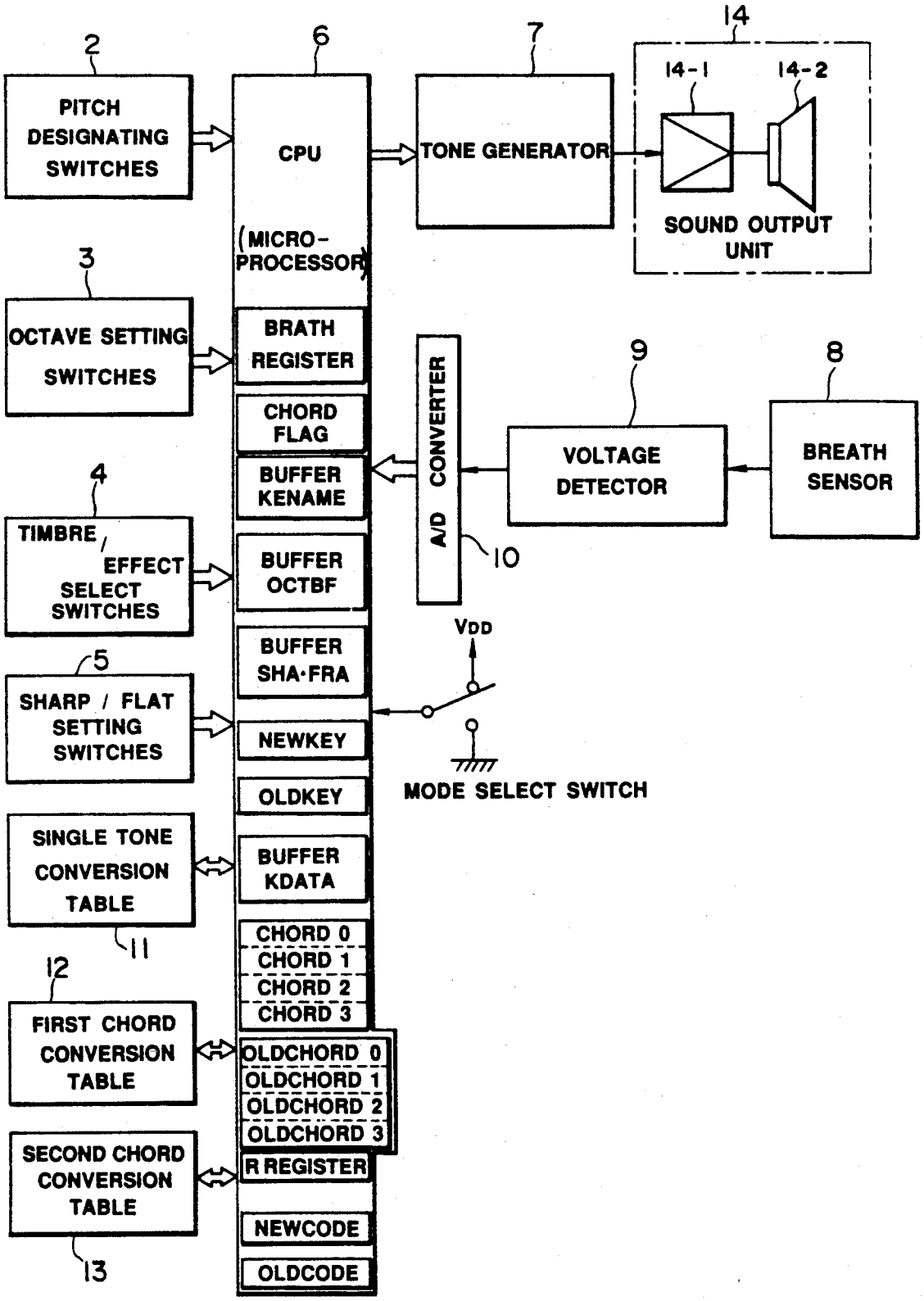
FIG. 1 is a diagram illustrating the system arrangement of one embodiment of this invention.

FIG. 1 illustrates the system arrangement of one embodiment of the present invention.

A mode selecting switch 1 serves to switch among a normal mode (normal playing mode) and two types of chord modes (chord playing modes) including chord modes 1 and 2. An ordinary melody can be played in normal mode, while chords can be played in chord mode (chord mode 1 or 2).

The mode selecting switch 1 is turned ON when coupled to a power source of voltage $V_{DD}$. The normal mode, chord mode 1 and chord mode 2 are switched from one to another every time the mode selecting switch is switched ON.

Pitch designating actuator or switches 2 include switches 2*a* to 2*g* serving to designate notes within one octave range of "$C_4$," "$D_4$," "$E_4$," "$F_4$," "$G_4$," "$A_4$" and "$B_4$." In normal mode the pitch designating switches 2 can designate pitches of musical tones within the above octave range by combinations of those switches depressed (in ON state). The root of a chord is designated in chord mode 1 whereas the type of a chord and the root thereof are designated in chord mode 2, as will be described later.

Octave setting switches 3 serve to command alteration of an octave with respect to the pitch of a musical tone designated by operation of the pitch designating switches 1 in normal mode and chord mode 2. Five types of octaves can be set by operating these switches 3. For instance, with the pitch of "$C_4$" designated by operation of the pitch designating switches, octaves of "$C_2$," "$C_3$," "$C_4$," "$C_5$" and "$C_6$" which are notes of "C" can be set. In chord mode 1, the type of any one of a minor 7th chord, minor chord, major chord, SUS chord (suspended chord) and augmented chord can be set through operation of the octave setting switches 3.

Timbre/effect select switches 4 serve to select the timbre of a musical tone and select whether or not to add various effects to the musical tone.

The octave setting switches 3 and timbre/effect select switches 4 are parameter designating switches which designate parameters such as an octave and timbre/effects for the pitch of a musical tone designated by the operation of the pitch designating switches 2.

Sharp/flat setting switches 5 include a sharp (#) setting switch 5*a* and a flat (b) setting switch 5*b*. The former switch 5*a* serves to designate a pitch a half tone higher than the one designated by operation of the pitch designating switches 2. The flat setting switch 5*b* serves to designate a pitch a half tone lower than the one designated by operation of the switches 2.

In other words, when switched ON, the sharp setting switch 5*a* and flat setting switch 5*b* can respectively set half tone higher and lower pitches.

Accordingly, pitch designation in the range between "$B_1$" and "$C_7$" as shown in FIG. 2 is possible by operating the pitch designating switches 2, octave setting switches 3 and sharp/flat setting switches 5. The pitches of "$B_1$" to "$C_7$" correspond to the pitch data (internal code values) shown in FIG. 2, and a CPU (central processing unit) 6 uses this pitch data to executes its process.

The CPU 6, comprising a microprocessor, for example, scans the status (ON/OFF state) of each of the mode selecting switch 1, pitch designating switches 2, octave setting switches 3, timbre/effect select switches 4 and sharp/flat setting switches 5 in predetermined intervals in a timer interrupt or the like, and acquires the pitch (in normal mode) designated by the switches 2, the pitch of the root of a chord (in chord mode 1) or the type of a chord and the pitch of the root of the chord (in chord mode 2) from the status data of the switches 2. From the scanned status data of the octave setting switches 3, the CPU 6 determines the octave (in normal mode and chord mode 2) designated by the switches 3 or the type of a chord (in chord mode 1). From the status data of the timbre/effect select switches 4, the CPU 6 determines the timbre/effect designated by the operation of the switches 4. When pitch designation is altered in normal mode, the CPU 6 sends pitch data to a tone generator 7 to generate a musical tone at the newly designated pitch. Further, the CPU 6 sends timbre data to the tone generator 7 to generate a musical tone with the designated timbre and controls the tone generator 7 so as to add the specified effect to the musical tone.

A breath sensor 8 detects strength (or volume) information of a player's breath blown through the mouth section of the electronic wind instrument body, and the information sensed by the sensor 8 is converted into its corresponding analog voltage (sense signal) by a voltage detector 9 before it is supplied to an A/D converter 10. This A/D converter 10 converts the received analog voltage into digital data (breath data) and sends it to the CPU 6. Based on the breath data from the A/D converter 10, the CPU 6 prepares key-ON data for starting tone generation, key-OFF data for stopping the tone generation or volume data for specifying the volume level of a musical tone generated from the tone generator 7 and outputs the data to the tone generator 7.

Built in the CPU 6 are a chord flag, various buffers such as KENAME, OCTBF, NEWKEY, OLDKEY, KDATA, CHORD0, CHORD1, CHORD2, CHORD3, OLDCHORD1, OLDCHORD2, OLDCHORD3, NEWCODE and OLDCODE, and various registers such as BRATH and R registers, which will be described in detail later.

The R register serves to hold in bit units the status data of each of the pitch designating switches 2*a*–2*g* which is scanned by the CPU 6, and has a 7-bit structure as shown in FIG. 3A. As this diagram clearly shows, the status data of each of the switches 2*a* to 2*g* are respectively stored in the individual bits 1 (LSB) to 7 (MSB) of the R register. The value of each bit is "1" when its associated switch is ON and "0" when it is OFF (see FIG. 3B).

For instance, when only the switch 2*a* is ON, only the LSB (bit 1) is set to "1" as indicated by 20-1 in FIG. 3B. When only the switches 2*a* and 2*b* are ON, only the bit 1 (LSB) and bit 2 are set to "1" as indicated by 20-3 in FIG. 3B.

A single tone conversion table 11 holds the contents of the R register and pitch data (internal code values) of single tones corresponding to these contents as shown in FIG. 4.

The CPU 6 searches through the single tone conversion table 11 using the content of the R register as a key to acquire the pitch data of a single tone designated by operation of the pitch designating switches 2 in normal mode.

For instance, when all the pitch designating switches 2a–2g are switched ON and the tone or pitch name "$C_4$" of the 4-th octave is specified, every bit of the R register becomes "1" and the CPU 6 searches through the single tone conversion table 11 and reads out pitch data (internal code value) "60" (in decimal notation) corresponding to the content of the R register having all the bits set to "1."

A first chord conversion table 12 holds chord data 30 consisting of a pair of chord data 30-1 and pitch data 30-2 of each constituent of a chord corresponding to the chord data 30-1 for every chord designated in chord mode 1, as shown in FIG. 5. These data, which will be described later, are associated with a chord set by operating the pitch designating switches 2 and octave setting switches 3 in chord mode 1. The CPU 6 searches through the first chord conversion table 12 using the chord data 30-1 as a key and reads out pitch data of the individual constituents of the designated chord. Although the individual constituents of each chord stored in a chord constituent region 30 are indicated by pitch symbols such as "$C_4$" and "$E_4$" in FIG. 5, actually pitch data internal code values) corresponding to these pitch symbols are stored.

A second chord conversion table 13 holds pitch data (internal code values) of the individual constituents of every chord designated in chord mode 2, as shown in FIG. 6. The pitch data (internal code values) of the individual constituents of a chord designated by operation of the pitch designating switches 2 is stored in the conversion table 13 at an address corresponding to the value of the R register.

In chord mode 2, the CPU 6 searches through the second chord conversion table 13 using the value of the R register holding the status data of each of the pitch designating switches 2 as a key and reads out pitch data (internal code values) of the individual constituents of the chord designated by operation of the switches 2.

The tone generator 7 has an analog sound source or a digital sound source such as an FM sound source or PCM sound source, and can simultaneously generate a plurality of musical tone signals with different pitches. Based on the pitch data, timbre data, volume data, etc. sent from the CPU 6 in normal mode, the tone generator 7 generates a musical tone signal at the designated pitch with musical characteristics such as the timbre and volume corresponding to the above timbre data and volume data. The tone generator 7 starts generating the musical tone upon reception of key-ON data from the CPU 6, and stops the tone generation upon reception of key-OFF data from the CPU 6. The musical tone signal from the tone generator 7 is sent to a sound or tone output unit 14.

When the chord mode 1 is selected, the CPU 6 searches the single tone conversion table 11 shown in FIG. 4 from the status data of the pitch designating switches 2 stored in the R register to obtain the root of a chord and obtains the type of the chord from the status data of the octave setting switches 3. Based on the root and type of the chord, the CPU 6 prepares pitch data of each constituent of the chord and sends it to the tone generator 7.

When the chord mode 2 is selected, the CPU 6 searches the root and type of a chord from the status data of the pitch designating switches 2 stored in the R register. Based on the status data of the octave setting switches 3 and sharp/flat setting switches 5, the CPU 6 alters the pitches of the individual constituents of the chord and sends the resulting pitch data of each constituent of the chord to the tone generator 7.

Based on the received pitch data of each chord constituent, the tone generator 7 generates the chord and sends it to the tone output unit 14. The tone output unit 14 comprises an amplifier 14-1 and a loud speaker 14-2 and produces a single tone or a chord sent from the tone generator 7 outside as a sound.

Figure 7A:
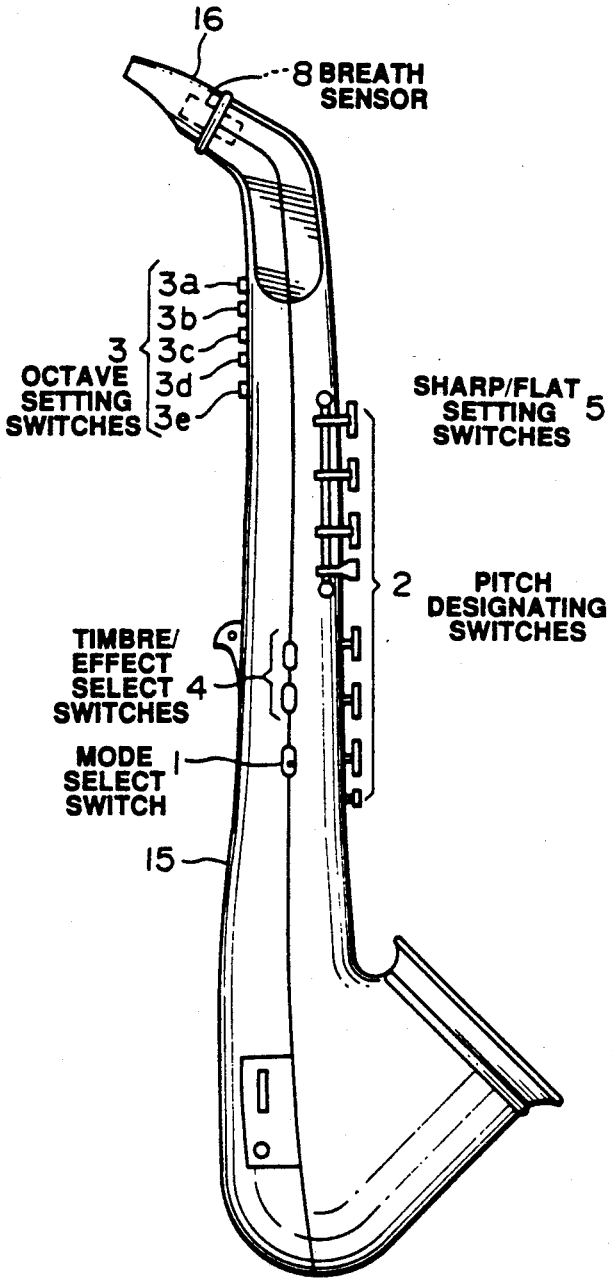
FIGS. 7A and 7B are perspective views of the one embodiment of this invention.
Figure 7B:
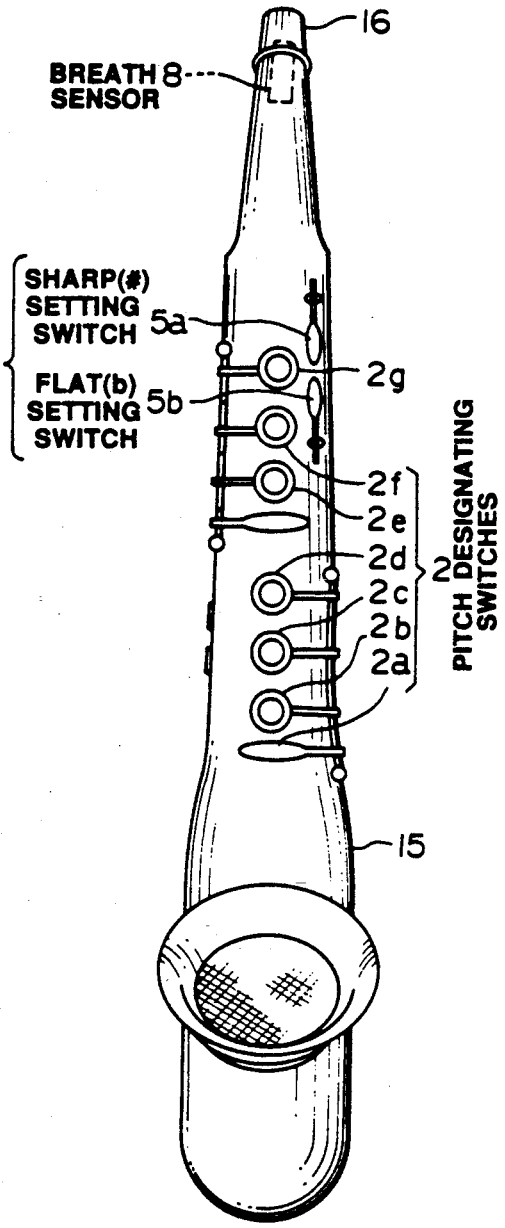

FIGS. 7A and 7B are outer views of an electronic wind instrument realized by providing various switches illustrated in FIG. 1. This embodiment takes the shape of a wind instrument having a horn section 15 and a mouth section 16. The pitch designating switches 2 comprising the switches 2a–2g, octave setting switches 3 comprising the switches 3a–3e, timbre/effect select switch 4 and sharp/flat setting switches 5a and 5b, which have been explained referring to FIG. 1, are provided on the horn section 15 where a player can easily put his fingers on.

The breath sensor 8 shown in FIG. 1 is provided near the joint between the mouth section 16 and the horn section 15.

The other elements also shown in FIG. 1 are provided at the interior of the horn section 15 shown in FIGS. 7A and 7B.

OPERATION

FIGS. 8A through 8F are diagrams for explaining how to play a music in normal mode and chord mode 1.

Figure 8:
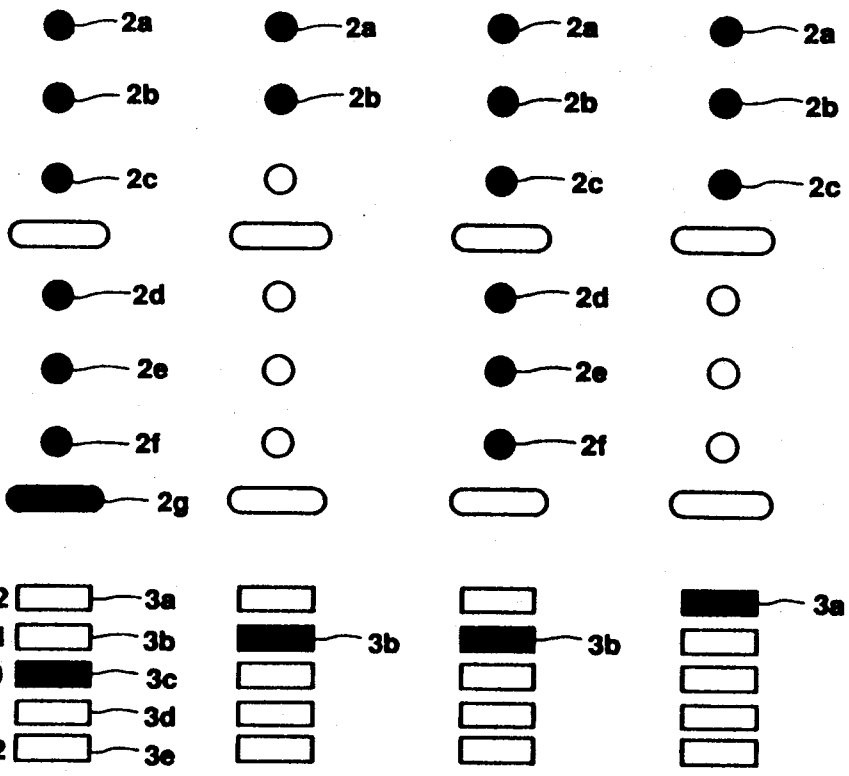
FIGS. 8A through 8F are diagrams for explaining how to set the pitches of musical tones (single tones) and chords in normal mode and chord mode 1 through operation of pitch designating switches and octave setting switches
Figure 8A:
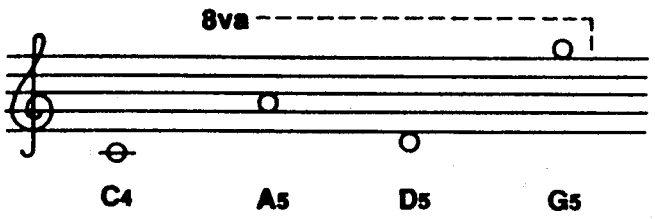

For instance, in playing a melody of "$C_4$," "$A_5$," "$D_5$" and "$G_6$" (the subscripts affixed to the individual pitch names "C," "A," "D" and "G" indicating an octave number) shown in FIG. 8A, the normal mode is selected by the mode selecting switch 1, then the pitch designating switches 2 and octave setting switches 3 are sequentially operated as shown in FIGS. 8C–8F while performing a breath operation to blow through the mouth section 16.

FIGS. 8C–8F illustrate the statuses of the pitch designating switches 2 and octave setting switches 3, and those switches activated (ON) are marked in black.

For instance, in setting the pitch of "$C_4$," as shown in FIG. 8C, the all the switches 2a–2g of the pitch designating switches are switched ON to designate the pitch of "$C_4$" and at the same time the switch 3c of the octave setting switches is switched ON to inform that no octave alteration will be made to the pitch designated by the switches 2.

In setting the pitch of "$A_5$," as shown in FIG. 8D, the switches 2a and 2b of the pitch designating switches are switched ON to designate the pitch name of "A" and at the same time the switch 3b of the octave setting switches is switched ON to specify "one octave above." Similarly, the pitches of "$D_5$" and "$G_6$" are set by performing the switch operations as shown in FIGS. 8E and 8F. In this manner, the pitches of "$A_4$" to "$G_4$" are designated by operation of the pitch designating switches 2 and "2 octaves above," "1 octave above," "no octave alteration," "1 octave below" and "2 octaves below" can be specified to those pitches designated by the pitch designating switches 2, by activating the associated switches 3a 3e of the octave setting switches 3.

Although not particularly illustrated, a pitch half tone higher than the one set in the above manner can be set by activating the sharp setting switch 5a and a half tone lower pitch can be set by activating the flat setting switch 5b.

Through a breath operation to blow through the mouth section 16 with a strength equal to or higher than a predetermined level, a musical tone (single tone) having the pitch set by operation of the pitch designating switches 2, octave setting switches 3 and sharp/flat setting switches 5 is generated from the tone generator 7 and produced as a sound from the tone output unit 14.

In normal mode, therefore, the pitch of the desired musical tone (single tone) can be set by operating the pitch designating switches 2, octave setting switches 3 and sharp/flat setting switches 5, and the desired melody can be played by performing the above breath operation.

Figure 8B:
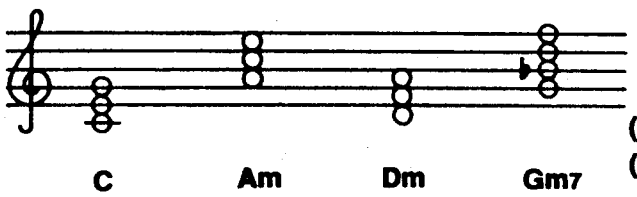

To play a harmony with a sequence of chords "C (C major)," "Am (A minor)," "Dm (D minor)" and "$G_7$ (G minor 7th)" as shown in FIG. 8B, the chord mode 1 should be selected by the mode selecting switch 1.

In chord mode 1, operating the pitch designating switches 2 specifies the roots of chords and operating the octave setting switches 3 specifies the types of chords, such as minor 7th chord, minor chord, major chord, suspended chord, and augmented chord. More specifically, the minor 7th chord, minor chord, major chord, suspended chord, and augmented chord are designated by respectively operating the switches **3*a* to 3*e* of the octave setting switches 3**.

In chord mode 1, therefore, the root "$C_4$" of the chord is set by operating the pitch designating switches 2 as shown in FIG. 8C and the "major chord" is set by operating the octave setting switch 3C as shown in the same diagram.

By effecting the aforementioned breath operation, the chord of "C (C major)" shown in FIG. 8B is generated from the tone generator 7 and produced as a sound from the tone output unit 14. Similarly, the chords "Am (A minor)," "Dm (D minor)" and "Gm7 (G minor 7th)" as shown in FIG. 8B are set by the operation of the pitch designating switches 2 and octave setting switches 3, and these chords are generated from the tone generator 7 and produced as a sound from the tone output unit 14 by effecting the breath operation.

In chord mode 1, therefore, the desired chord can be set by operating the pitch designating switches and octave setting switches 3 and this chord can be played by effecting the breath operation.

The following will describe how to play a chord when the chord mode 2 is selected by the mode selecting switch 1, referring to FIGS. 9A–9F. Those switches activated (ON) are also marked in black.

In chord mode 2, the octave setting switches 3 will not be operated, and the types of chords (major chord, minor chord, major 7th chord, etc.) and the roots of the chords are set by operating only the pitch designating switches 2. Operating the octave setting switches 3 can set and alter in the units of octaves the pitches of the constituents of each chord set in the above manner.

The functions of the individual octave setting switches 3 are the same as those in normal mode. That is, the pitch of each constituent of the chord set by the operation of the pitch designating switches 2 can be altered in the units of octaves like "2 octaves above," "1 octave above," "no octave alteration," "1 octave below" and "2 octaves below" by activating the associated switches **3*a*–3*e* of the octave setting switches 3**.

In chord mode 2, the individual switches **2*a*–2*g* of the pitch designating switches are respectively assigned with the pitches "$C_4$" (switch 2*g*), "$D_4$" (switch 2*f*), "$E_4$" (switch 2*e*), "$F_4$" (switch 2*d*), "$G_4$" (switch 2*c*), "$A_4$" (switch 2*b*) and "$B_4$" (switch 2*a*), as indicated within the parentheses "( )" affixed on the right of the switches in FIG. 9B**.

In designating a major chord, that of the pitch designating switches 2 which is associated with the pitch name of the root of the desire chord is activated, then the octave alteration of the pitch of the root is specified by operation of the octave setting switches 3.

Figure 9A:
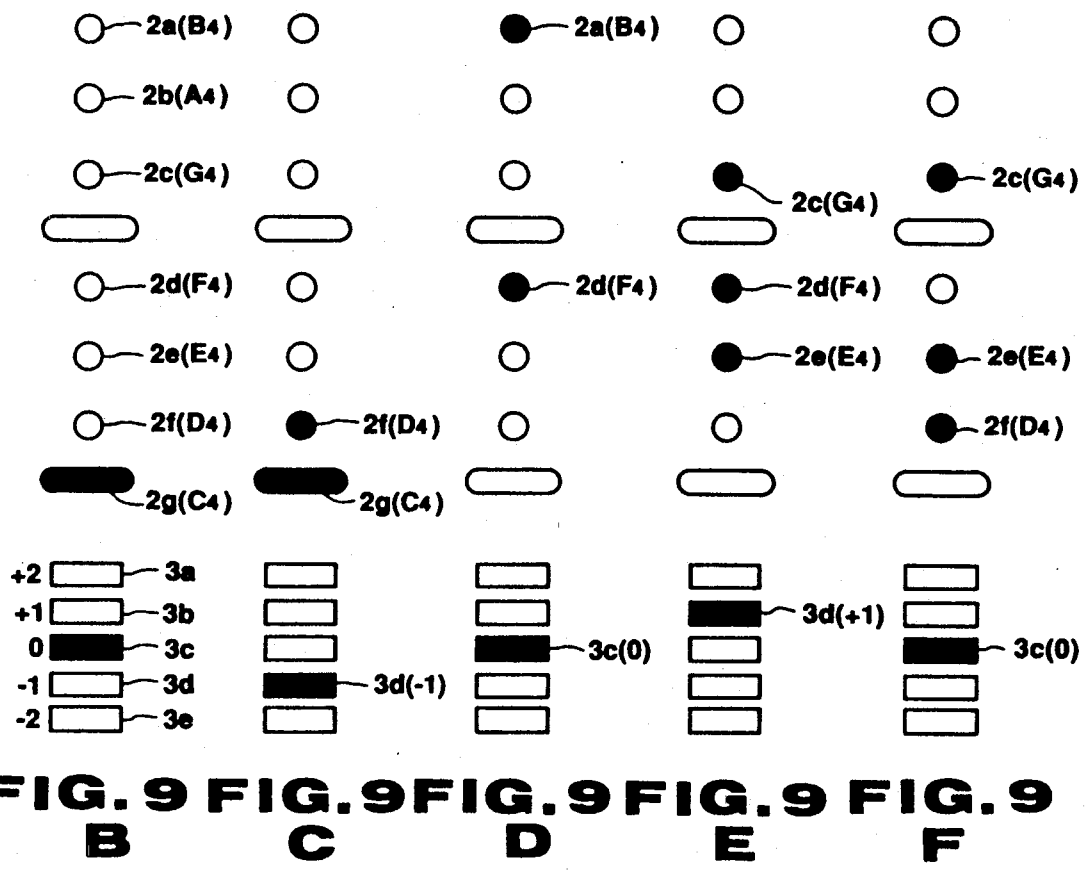
Figure 9A:
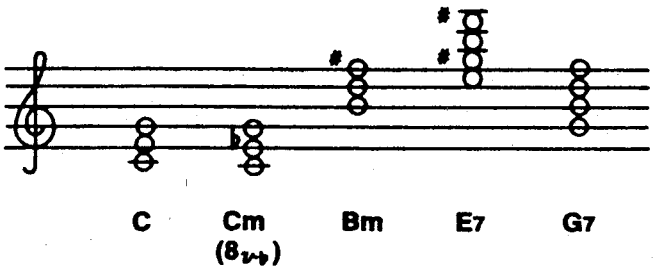
Figure 10:
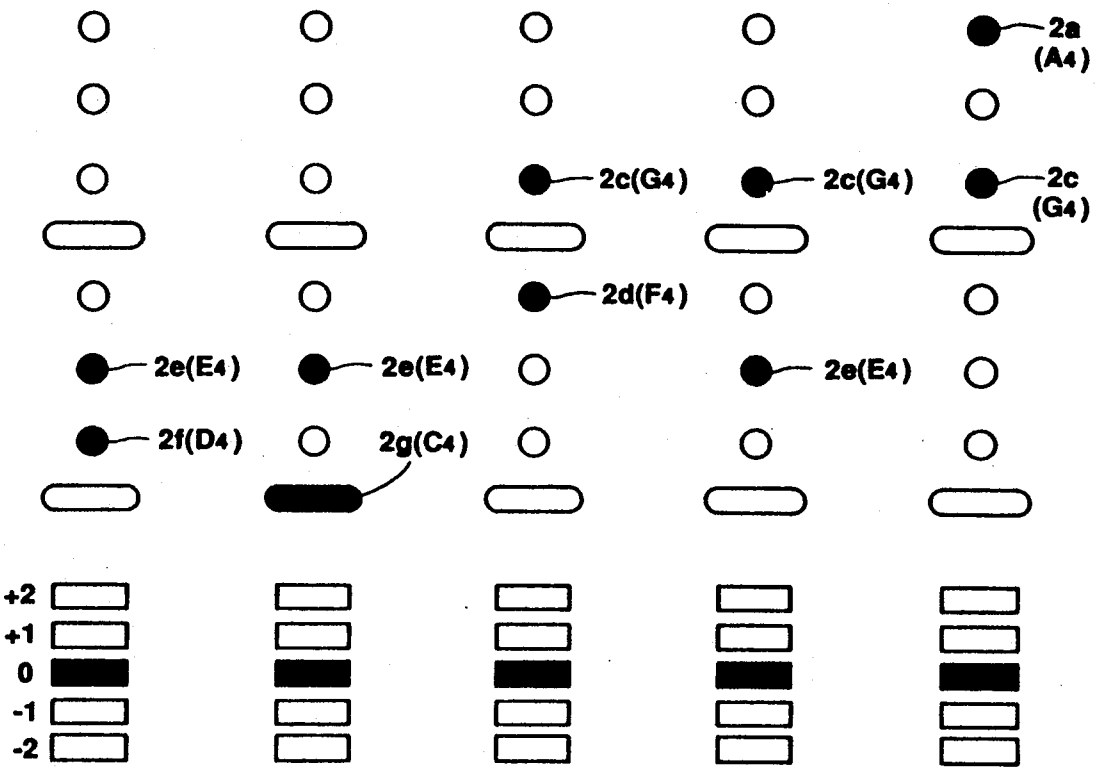
FIGS. 10A through 10F are diagrams for explaining how to set minor chords in chord mode 2.
Figure 10A:
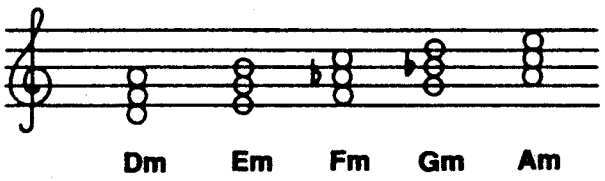
Figure 11:
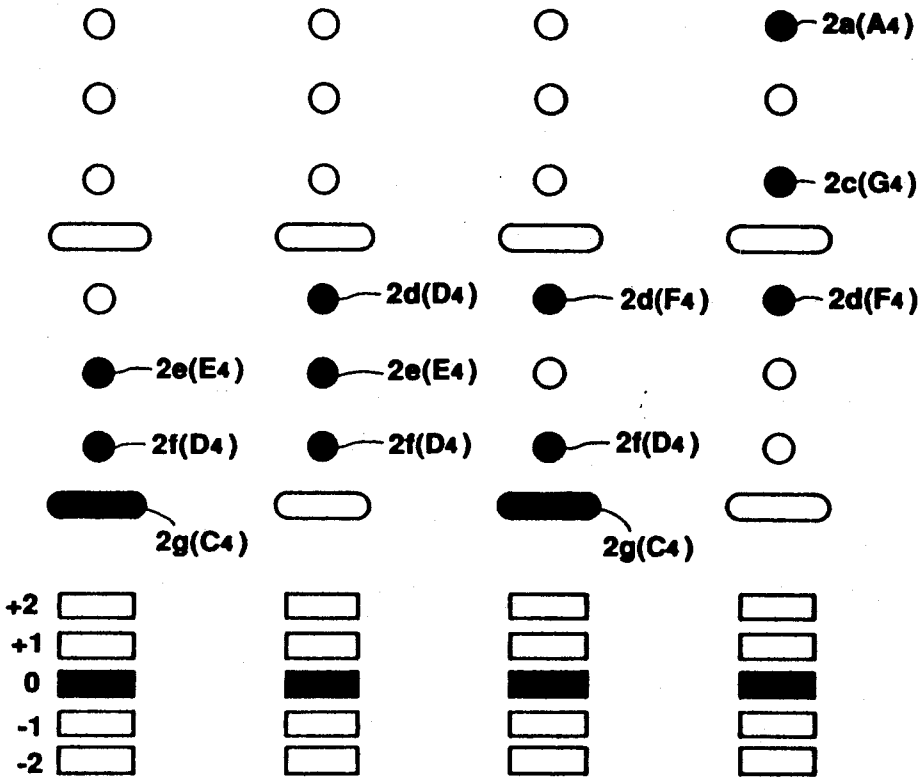
FIGS. 11A through 11E are diagrams for explaining how to set major seventh chords in chord mode 2.
Figure 11A:
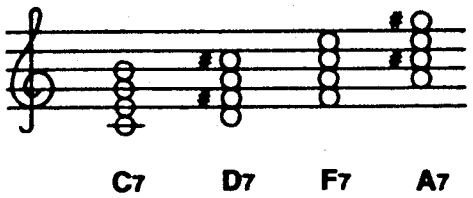

For instance, in setting the C major chord having "$C_4$" as its root as shown in FIG. 9A, the switch **2*g* associated with the pitch of "$C_4$" is activated and the switch 3*c* associated with "no octave alteration" is activated, as shown in FIG. 9B**.

In specifying a minor chord, any two of the pitch designating switches 2 are switched ON. If, at this time, the designated two pitch names are adjacent to each other (having an adjacent pitch relation), the lowest pitch designated will be the root of the minor chord. For instance, when the switch **2*g* associated with the pitch name "$C_4$" and the switch 2*f* associated with the pitch name "$D_4$" are switched ON as shown in FIG. 9C, the C minor chord having the lowest pitch "$C_4$" as its root is specified since those two designated pitches "$C_4$" and "$D_4$" have a continuous pitch relation. Since the switch 3*d*** is ON specifying "1 octave below," the C minor chord (Cm) having the pitch "$C_3$" as the root is specified.

If the designated two pitch names are not adjacent to each other (having a non-adjacent pitch relation), a minor chord having the highest pitch designated as the root is set. For instance, when the switch **2*a* associated with the pitch name "$B_4$" and the switch 2*d* associated with the pitch name "$F_4$" are switched ON, with the switch 3*c* for specifying "no octave alteration" being switched ON as shown in FIG. 9D, "$B_4$" and "$F_4$" have a non-adjacent pitch relation and "$B_4$" is the highest pitch. Accordingly, the B minor chord (Bm) having the highest pitch "$B_4$" (see FIG. 9A**) as its root is specified.

Similarly, a D minor chord (Dm), E minor chord (Em), F minor chord (Fm) and G minor chord (Gm) other than the aforementioned C minor chord (Cm) and B minor chord (Bm) can be set by operating the pitch designating switches 2 and octave setting switches 3 as shown in FIGS. 10B to 10F. That is, it is possible to set minor chords having all the notes of "C," "D," "E," "F," "G," "A" and "B" in one octave range as the roots.

In designating a major 7th chord, three of the pitch designating switches 2 need to be switched ON.

If, at this time, the designated three pitches have an adjacent pitch relation, a major 7th chord having the lowest pitch designated as the root is set. For instance, when the switches **2*c* to 2*e* are switched ON, with the switch 3*b* for specifying "1 octave above" being switched ON as shown in FIG. 9E, the E major 7th chord ($E_7$) (see FIG. 9A) having the lowest pitch "$E_5$" (associated with the switch 2*c***) as its root is specified.

If the designated three pitches have a non-adjacent pitch relation, on the other hand, a major 7th chord having the highest pitch designated as the root is set. For instance, when the switches **2*c*, 2*e* and 2*f* are switched ON, with the switch 3*c* for specifying "no octave alteration" being switched ON as shown in FIG. 9F, the G major 7th chord ($G_7$) (see FIG. 9A**) having the highest pitch "$G_4$" as its root is specified.

Similarly, a C major 7th chord ($C_7$), D major 7th chord ($D_7$), F major 7th chord ($F_7$) and A major 7th chord ($A_7$) other than the aforementioned E major 7th chord ($E_7$) and G major 7th chord ($G_7$) can be set by operating the pitch designating switches 2 and octave setting switches 3 as shown in FIGS. 11B to 11E. That is, it is possible to set major 7th chords having all the notes of "C," "D," "E," "F," "G," "A" and "B" in one octave range as the roots.

Figure 12:
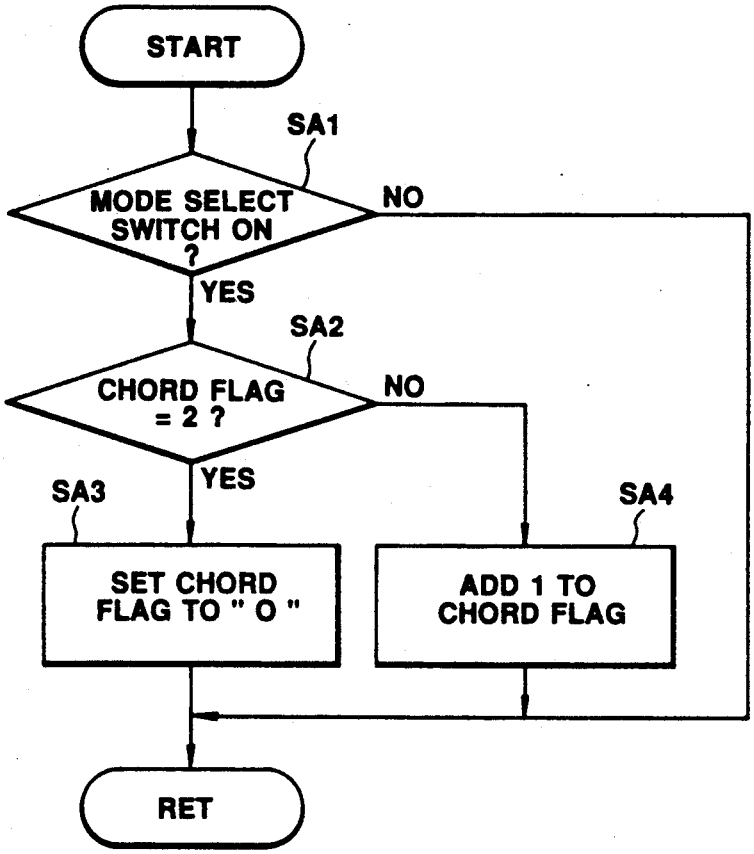
FIG. 12 is a flowchart for explaining the operation of a CPU when a mode selecting switch is operated.

The switching between the normal mode, chord mode 1 and chord mode 2 by means of the mode selecting switch 1 is done by the CPU 6 executing the operational flowchart shown in FIG. 12.

The chord flag used in the flowchart is for storing the presently selected mode; it stores "0" for normal mode, "1" for chord mode 1 and "2" for chord mode 2.

The CPU 6 discriminates whether or not the mode selecting switch 1 is ON (SA1), then discriminates whether or not the chord flag is set to "2" (SA2) if the switch 1 is ON.

If the chord flag is set to "2" (i.e., if the chord mode 2 has been selected), this flag is then set to "0" (SA3).

If the chord flag is not set to "2" in SA2, i.e., if it is "0" or "1," the value of the flag is incremented by 1 (SA4).

Through the above operation, every time the mode selecting switch 1 is switched ON, the mode will be changed in the sequence of normal mode (chord flag=0)→chord mode 1 (chord flag=1)→chord mode 2 (chord flag=2)→normal mode (chord flag=0)→. . .

Figure 13:
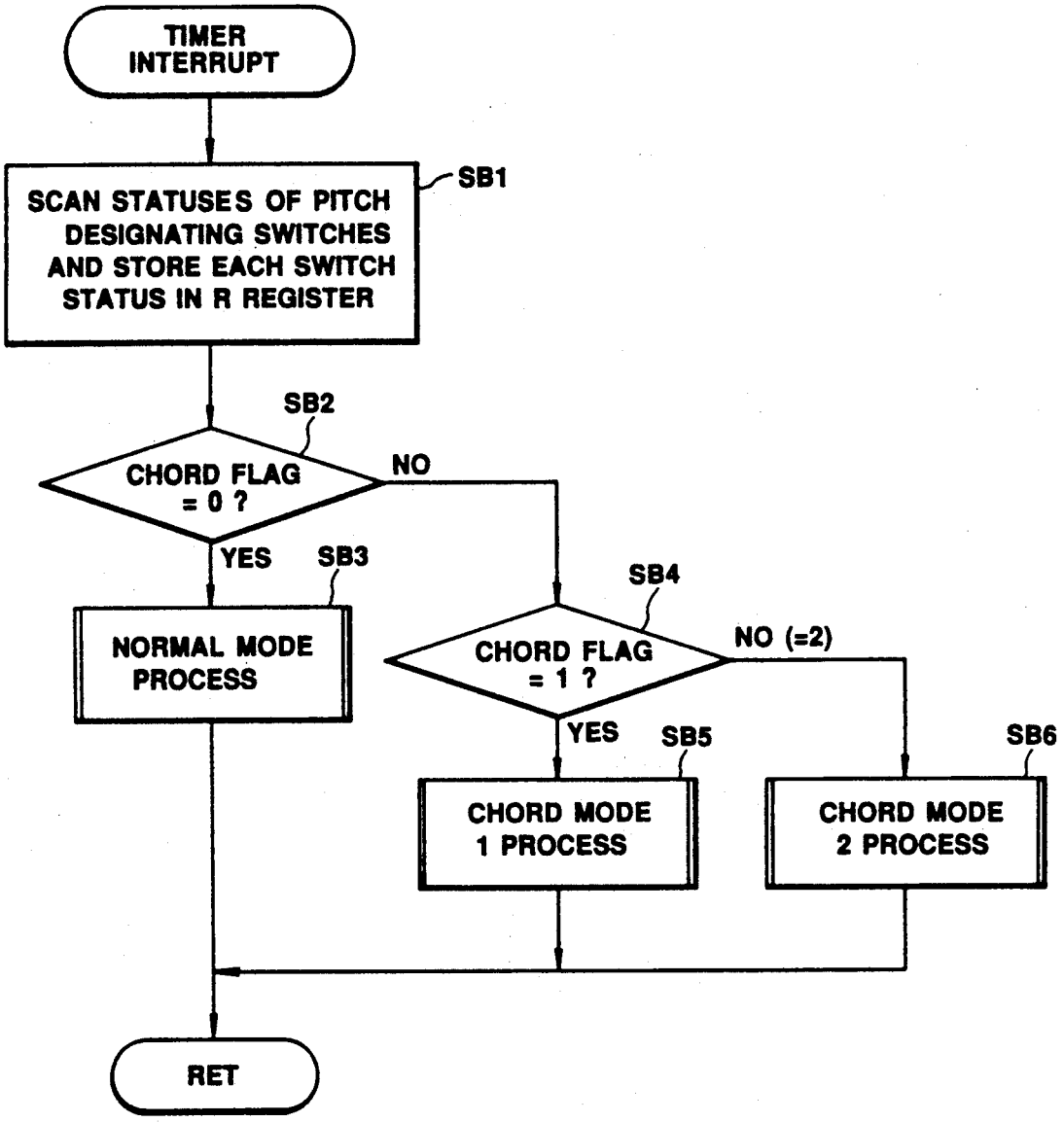
FIG. 13 is a flowchart for explaining a process the CPU executes based on a chord flag.

The CPU 6 executes the process of the operational flowchart shown in FIG. 13 based on the chord flag upon occurrence of a timer interrupt at a predetermined cycle.

First, the statuses (ON/OFF states) of the individual switches 2a–2g of the pitch designating switches 2 are scanned and are stored in the R register shown in FIG. 2A (SB1). As a result, the statuses of the switches 2a–2g are stored in the first bit (LSB) to seventh bit (MSB) of the R register, respectively.

Subsequently, the CPU 6 discriminates whether or not the value of the chord flag is "0" (SB2) and executes the normal mode process to generate a musical tone (single tone) at the pitch designated by the operation of the pitch designating switches 2 if the flag is "0" (i.e., if the normal mode has been selected) (SB3).

If the value of the chord flag is not "0" in SB2, on the other hand, the CPU 6 then discriminates whether or not the value of the chord flag is "1" (SB4). If the chord flag is "1" (if the chord mode 1 has been selected), the CPU 6 executes the chord mode 1 process to generate a chord whose root is the pitch designated by the operation of the pitch designating switches 2 and which is designated by the operation of the octave setting switches 3 (SB5).

If the chord flag is not "1" in SB4, i.e., if it is "2" (chord mode 2 having been selected), the CPU 6 executes the chord mode 2 process to generate a chord designated by the operation of the pitch designating switches 2 (SB6).

Figure 14:
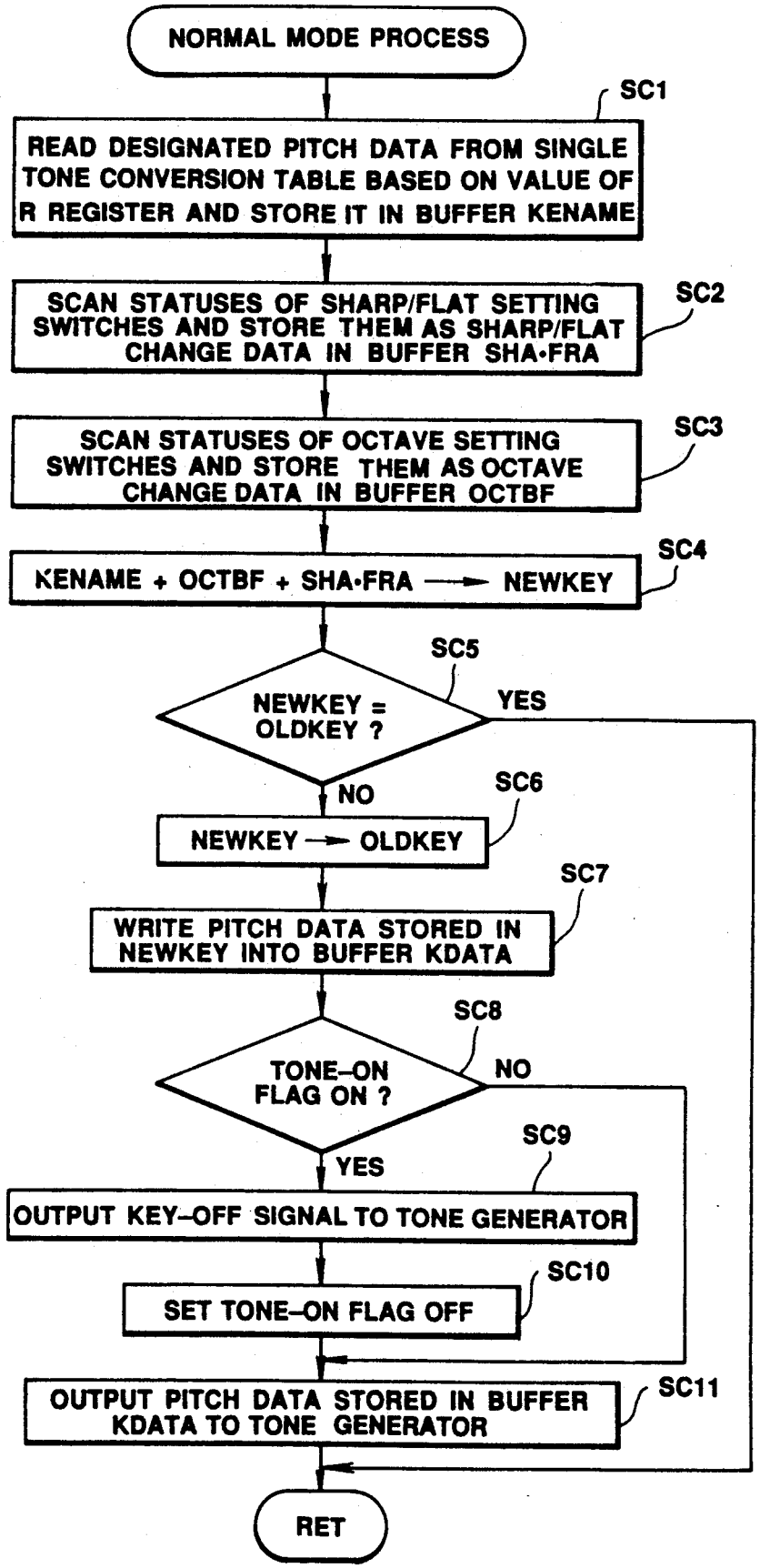
FIG. 14 is a flowchart for explaining a normal mode process executed by the CPU.

FIG. 14 illustrates the operational flowchart for explaining the normal mode process SB3.

First, the CPU 6 searches the single tone conversion table 11 shown in FIG. 3 using the value of the R register as a key, reads out the pitch data (internal code value) designated by operation of the pitch designating switches 2 and stores the pitch data in the buffer KENAME (SC1).

Through the above operation, if only the switch 2g of the pitch designating switches 2 is switched ON, for example, only the bit 7 (MSB) of the R register becomes "1" and the other bits 1 (LSB) to 6 all become "0" because of the process SB1 shown in FIG. 13. Accordingly, the CPU 6 searches the single tone conversion table 11, reads out pitch data "71" of "$B_4$" (4-th octave of "B") corresponding to the content of the R register and stores the data in the buffer KENAME (see FIG. 4).

Subsequently, the CPU 6 scans the statuses of the sharp/flat setting switches 5, and it sets "1" in the buffer SHA.FRA if sharp setting switch 5a is ON and sets "−1" therein if the flat setting switch 5b is ON (SC2).

Then, the CPU 6 scans the statuses of the individual switches 3a–3e of the octave setting switches 3 and stores octave change data corresponding to activated switches in the buffer OCTBF (SC3). For instance, if the switch 3b is ON, octave change data "12" is written in the buffer OCTBF. If the switches 3a, 3c, 3d and 3e are ON, octave change data of "24," "0," "−12" and "−24" are respectively written in the buffer OCTBF.

As shown in FIG. 2, the pitch data (internal code value) of the pitch of the same pitch name increases by 12 upon each 1-octave increment and decreases by 12 upon each 1-octave decrement. The above operation permits the buffer OCTBF to store values corresponding to pitch differences associated with a command to alter the 4-th octave pitch designated by the operation of the pitch designating switches 2 in the units of octaves designated by the operation of the octave setting switches 3.

Subsequently, the values of the buffers KENAME, OCTBF and SHA.FRA are added together and the resultant value is stored in the buffer NEWKEY (SC4).

This operation permits the buffer NEWKEY to store the pitch data (internal code value) designated by the pitch designating switches 2, octave setting switches 3 and sharp/flat setting switches 5.

The CPU 6 then discriminates whether or not the value in the buffer NEWKE equals the value in buffer OLDKEY (SC5).

As the buffer OLDKEY contains the previously designated pitch data (which will be described later), the value in the buffer NEWKEY becomes equal to that in the buffer OLDKEY if the previous operation of the pitch designating switches 2, octave setting switches 3 and sharp/flat setting switches 5 is the same as the present operation thereof. It is therefore discriminated whether or not pitch designation has been changed by determining if the values in the buffers NEWKEY and OLDKEY equals each other.

If the present pitch designation is determined to be different from the previous one in SB4, the value of the buffer NEWKEY is stored in the buffer OLDKEY (SC6). The pitch data stored in the buffer NEWKEY is then written in the buffer KDATA (SC7) and it is discriminated whether or not a tone-ON flag is ON (SC8).

The tone-ON flag serves to memorize whether a musical tone is presently generated from the tone generator 7; it holds "1" (ON) if the tone generation is in progress and "0" (OFF) if otherwise.

If the tone-ON flag is ON in SC8, the CPU 6 outputs a key-OFF signal to the tone generator 7 to specify interruption of the tone generation (SC9) and sets the tone-ON flag to "0" (OFF) (SClO). The pitch data stored in the buffer KDATA is then sent to the tone generator 7 (SC11).

If the pitch designation changes through the above operation, tone generation from the tone generator 7 will be stopped when a musical tone is presently produced therefrom, and newly designated pitch data will be sent to the tone generator 7. The tone-ON flag is reset to "0" (OFF) from the "1" (ON) status.

If it is discriminated in SC5 that no alteration has been made to pitch designation, the process will be terminated immediately.

Figure 15:
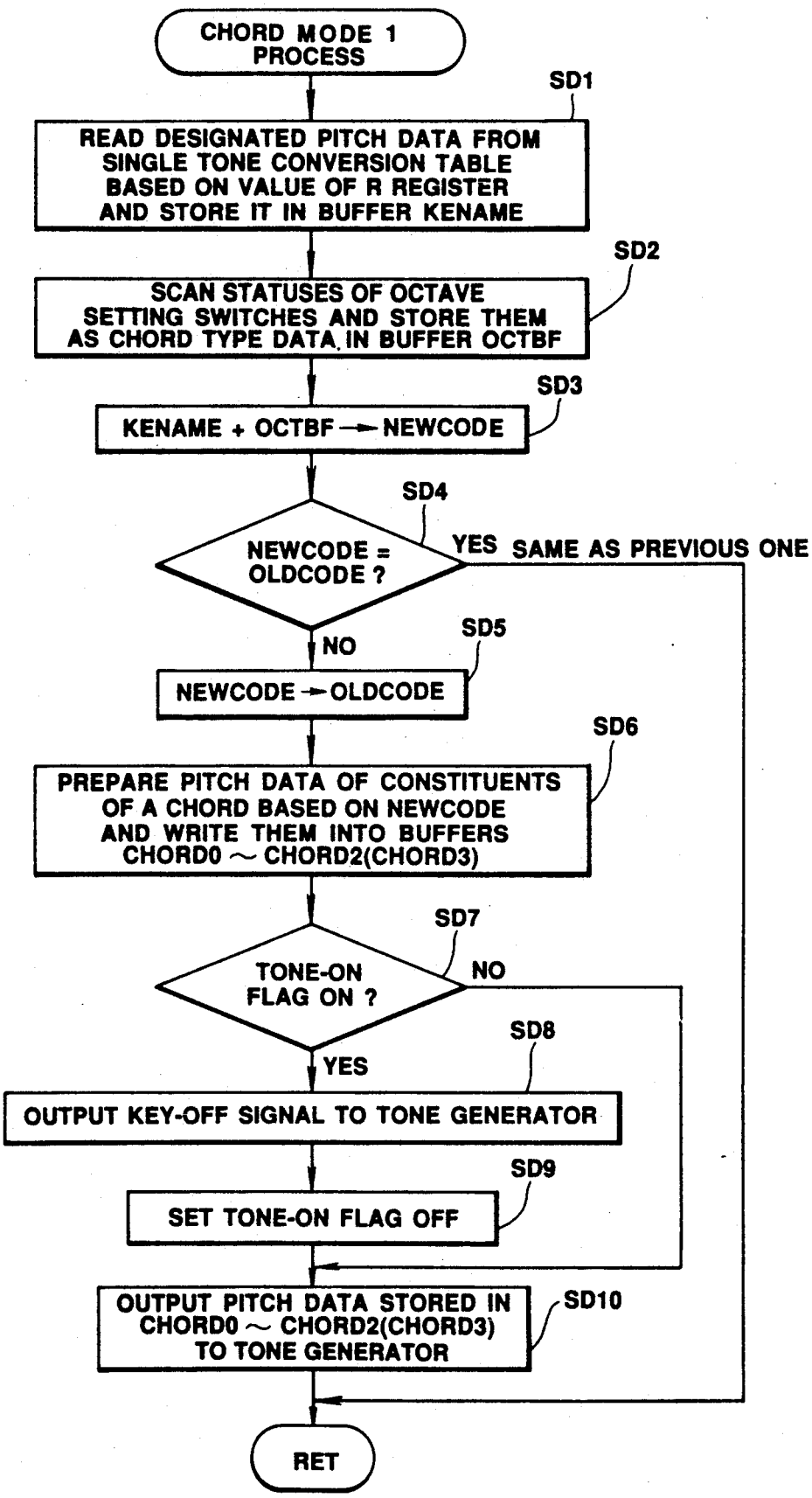
FIG. 15 is a flowchart for explaining in detail a chord mode 1 process performed by the CPU.

A detailed description will be given of the chord mode 1 process of the aforementioned SB5, referring to the flowchart shown in FIG. 15.

First, the CPU 6 searches the single tone conversion table 11 using the value of the R register as a key, and stores the pitch data of the root of the chord designated by operation of the pitch designating switches 2, in the buffer KENAME (SD1).

Subsequently, the CPU 6 scans the statuses of the octave setting switches 3 and stores the chord type data designated by the operation of the switches 3 into the buffer OCTBF (SD2). The values of the chord type data are the same as those of the aforementioned octave change data in normal mode. That is, the value of the chord type data is "24" when the switch 3*a* is switched ON specifying a minor 7th chord, is "12" when the switch 3*b* is switched ON specifying a minor chord, and is "0" when the switch 3*c* is switched ON specifying a major chord. Similarly, the value of the chord type data is "−12" when the switch 3*d* is switched ON specifying a suspended chord and "−24" when the switch 3*e* is switched ON specifying an augmented chord.

Then, the pitch data (internal code value) of the root of a chord stored in the buffer KENAME is added to the designated chord type data stored in the buffer OCTBF, and the result (chord data 30-1) is stored in the buffer NEWCODE (SD3).

Since the pitch data (internal code value) increases (or decreases) by "12" for each 1-octave increment (or decrement), the result of the addition (value of the buffer NEWCODE) would differ every time the type of a chord differs.

The CPU 6 then discriminates whether or not the chord data 30-1 stored in the buffer NEWCODE equals the chord data 30-1 stored in the buffer OLDCODE (SD4).

As the buffer OLDCODE contains the chord data 30-1 previously designated (which will be described later), the values of the chord data 30-1 in the buffers NEWCODE AND OLDCODE become equal to each other if the chord previously designated by the operation of the pitch designating switches 2 and octave setting switches 3 is the same as the presently designated chord. It is therefore discriminated whether or not chord designation has been changed by determining if the value of the buffer NEWCODE equals that of the buffer OLDCODE.

It is discriminated in SD5 that alteration has been made to the chord designation, the chord data 30-1 stored in the buffer NEWCODE will be written in the buffer OLDCODE (SD5).

Then, the CPU 6 searches the first chord conversion table 12 shown in FIG. 5 using the chord data 30-1 in the buffer NEWCODE as key data, acquires pitch data of the root, third and fifth (also seventh in case of a minor 7th chord), which are the constituents of a chord corresponding to the chord data 30-1, and writes these pitch data in the buffers CHORD0-CHORD2 (CHORD3) (SD6).

In other words, when the chord mode 1 is selected, the CPU 6 searches the first chord conversion table 12 using as a key the chord data 30-1 which is the result of adding the pitch data (pitch data of the root of a chord) stored in the buffer KENAME to the chord type data stored in the buffer OCTBF, and prepares the pitch data of the root, third and fifth (also seventh in case of a minor 7th chord), which are the constituents of the designated chord.

For instance, in case of a C major chord having "$C_4$" as the root, the pitch data stored in the buffer KENAME would become "60" while the chord type data stored in the buffer OCTBF would be "0." Therefore, the chord data 30-1 stored in NEWCODE is "60" (=60+0). As shown in FIG. 5, the value of the chord data 30-1 associated with a C major chord is "60."

Similarly, in case of a C augmented chord having "$C_4$" as the root, KENAME="60" and OCTBF="−24," the value of the chord data 30-1 would be 60−24=36.

The first chord conversion table 11 shown in FIG. 5 contains the individual constituents of a C augmented chord as a chord associated with the chord data 30-1 having a value of "36."

Subsequently, the CPU 6 discriminates whether or not the tone-ON flag is ON ("1") (SD7), and outputs the key-OFF signal to the tone generator 7 if the flag is ON (SD8). Then, the CPU 6 sets the tone-ON flag OFF ("0") (SD9) and sends the pitch data of the constituents of a chord stored in the buffers CHORD0-CHORD2 (CHORD3) to the tone generator 7 (SD10).

If a musical tone is presently produced from the tone generator 7 when chord designation has been altered through the above operation, tone generation from the tone generator 7 is stopped and the pitch data of each constituent of a newly designated chord is sent to the tone generator 7. The tone-ON flag is reset to OFF ("0").

Figure 16A:
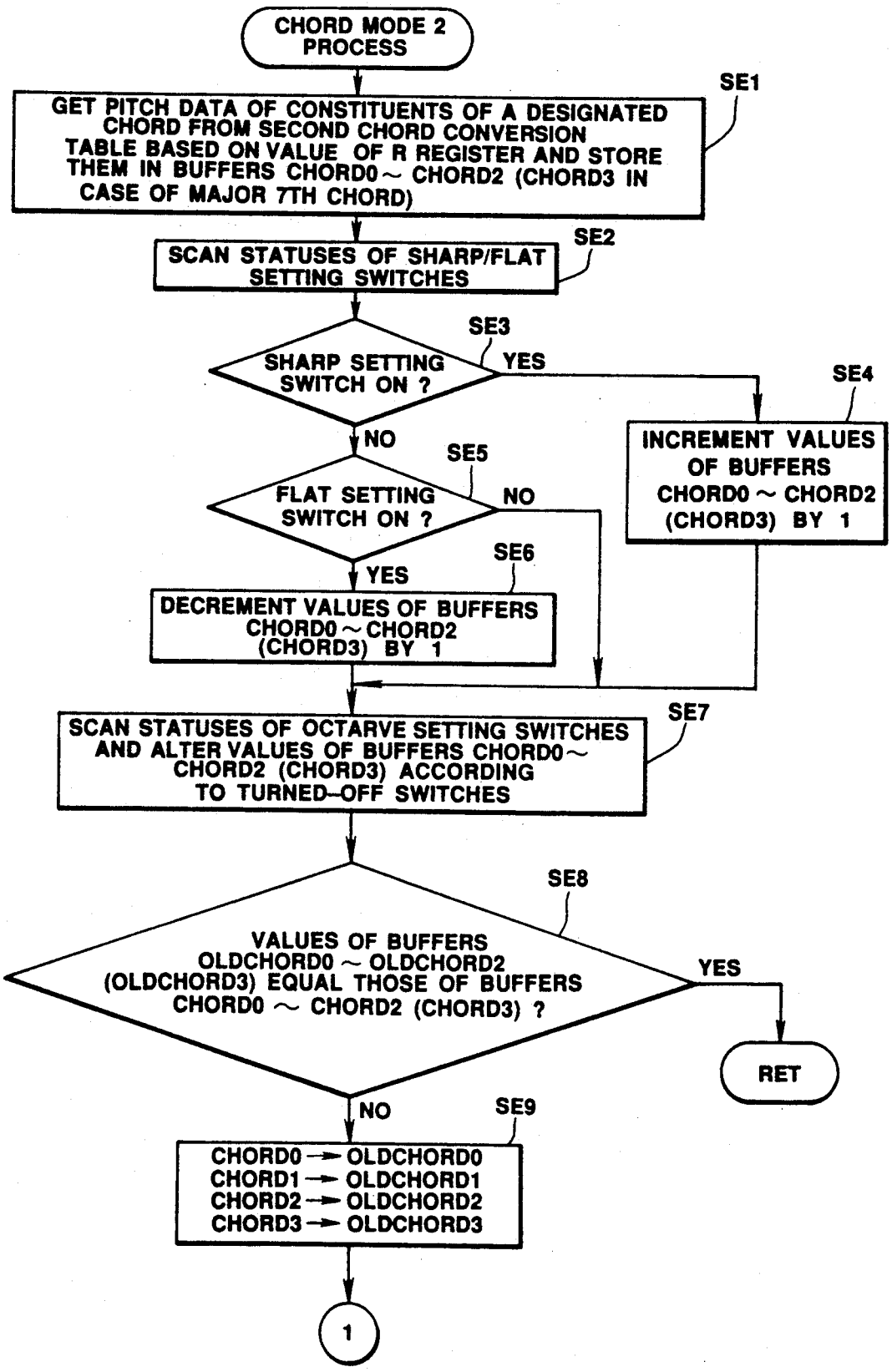
FIGS. 16A and 16B show a flowchart for explaining in detail a chord mode 2 process performed by the CPU.
Figure 16B:
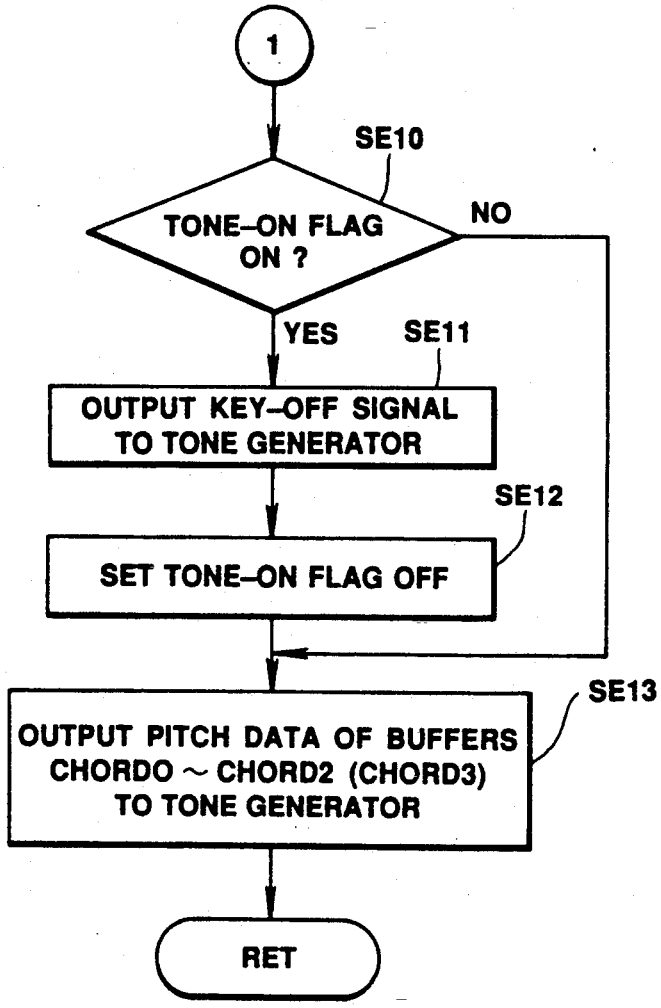

Referring to the flowchart of FIGS. 16A and 16B, a detailed description will be given of the chord mode 2 process of the process SB6 in the flowchart shown in FIG. 13.

First, the CPU attains pitch data of each constituent of a chord designated by operation of the pitch designating switches 2, from the second chord conversion table 13 shown in FIG. 6 based on the value of the R register and stores the attained pitch data in the buffers CHORD1 (root), CHORD1 (third), CHORD2 (fifth) and CHORD4 (seventh) (SE1).

The value of the R register is equal to the value of the address at which the pitch data of each corresponding chord constituent stored in the second chord conversion table 13, and this pitch data is acquired by reading pitch data from the second chord conversion table 13 at the address specified by the value of the R register.

For instance, when only the switch 2*a* of the pitch designating switches 2 is switched ON, a C major is specified as shown in FIG. 3B and the value of the R register would be "1."

Referring now to the second chord conversion table 13 of FIG. 6, pitch data (internal code values) of "$C_4$," "$E_4$" and "$G_4$," the constituents of the C major, are stored at the address 1. When the switches 2*a*–2*c* are switched ON, a C major 7th chord is specified as shown in FIG. 3B, and the value of the R register would be "7." Referring now to the second chord conversion table 13 of FIG. 6, pitch data (internal code values) of "$C_4$," "$E_4$," "$G_4$" and "$B_4b$," the constituents of the C major 7th chord, are stored at the address 7.

Then, the CPU 6 scans the statuses of the sharp/flat setting switches 5 (SE2) and discriminates whether or not the sharp setting switch 5a is ON (SE3). If the switch 5a is ON, the CPU 6 increments the values of the buffers CHORD0-CHORD2 (CHORD3) by 1 (SE4). If the switch 5a is OFF in SE3, the CPU 6 then discriminates whether or not the flat setting switch 5b is ON (SE5) and decrements the values of the buffers CHORD0-CHORD2 (CHORD3) by 1 (SE6).

If the sharp setting switch 5a is switched ON in the above operation, every constituent of the chord designated by the operation of the pitch designating switches 2 rises up a half tone. If the flat setting switch 5b is switched ON, every constituent of the chord falls a half tone.

Following the above-described SE4 or SE6, the CPU 6 scans the statuses of the individual octave setting switches 3 and alters the pitch data stored in the buffers CHORD0-CHORD2 (CHORD3) in the units of octaves in accordance with the octave setting switches 3a–3e switched OFF. More specifically, if the switch 3a is ON, the values of the buffers CHORD0-CHORD2 (CHORD3) are all incremented by "24" (2-octave increment), and if the switch 3b is ON, the values of the buffers CHORD0-CHORD2 (CHORD3) are all incremented by "12" (1-octave increment).

Similarly, when the switches 3c–3e are ON, those values of the buffers are incremented by "0" (no octave alteration), "−12" (1-octave decrement) and "−24" (2-octave decrement), respectively.

Through the above operation, the pitches of the individual constituents of the chord designated by the operation of the pitch designating switches 2 are altered in the units of octaves by operating the octave setting switches 3.

Subsequently, the CPU 6 discriminates whether or not the values of the buffers CHORD0-CHORD2 (CHORD3) equal those of OLDCHORD0-OLDCHORD2 (OLDCHORD3) (SE8).

OLDCHORD0-OLDCHORD2 (OLDCHORD3) contain pitch data of the constituents of the previously designated chord (which will be described later). When the present chord designation done by operating the pitch designating switches 2, octave setting switches 3 and sharp/flat setting switches 5 is the same as the previous one, the values of the buffers CHORD0-CHORD2 (CHORD3) respectively coincide with those of the buffers OLDCHORD0-OLDCHORD2 (OLDCHORD3). Accordingly, it is discriminated in the aforementioned SE8 whether or not chord designation has been changed.

If the decision in SE8 is alteration in chord designation, the values of the buffers CHORD0-CHORD2 (CHORD3) are stored in the buffers OLDCHORD0-OLDCHORD2 (OLDCHORD3), respectively (SE9) and it is then discriminated whether or not the tone-ON flag is ON ("1") (SE10).

If the tone-ON flag is ON, i.e., if a musical tone is presently generated from the tone generator 7, the key-OFF signal is sent to the tone generator 7 (SEll) and the tone-ON flag is set OFF ("0") (SE12). Subsequently, the pitch data stored in the buffers CHORD0-CHORD2 (CHORD3) are sent to the tone generator 7.

If chord designation is changed by the above operation during tone generation, tone generation is stopped and the pitch data of the individual constituents of a newly designated chord is sent to the tone generator 7.

As described above, a single tone of the desired pitch selected from the range of "$B_1$" to "$C_7$" shown in FIG. 2 can be set by operating the pitch designating switches 2, octave setting switches 3 and sharp/flat setting switches 5.

In chord mode 1, five types of chords, "minor 7th chord," "minor chord," "major chord," "suspended chord" and "augmented chord" having each the full scale notes of 1 octave can be set as the root by operating the pitch designating switches 2 and octave setting switches 3.

In chord mode 2, three types of chords, "major chord," "minor chord" and "major 7th chord" having each the full scale notes of 1 octave can be set at the root by operating the pitch designating switches 2, octave setting switches 3 and sharp/flat setting switches 5.

The single tone or chord set in the above manner can be generated from the tone generator 7 by performing a breath operation on the mouth section 15 at a strength equal to or greater than a predetermined level.

Figure 17:
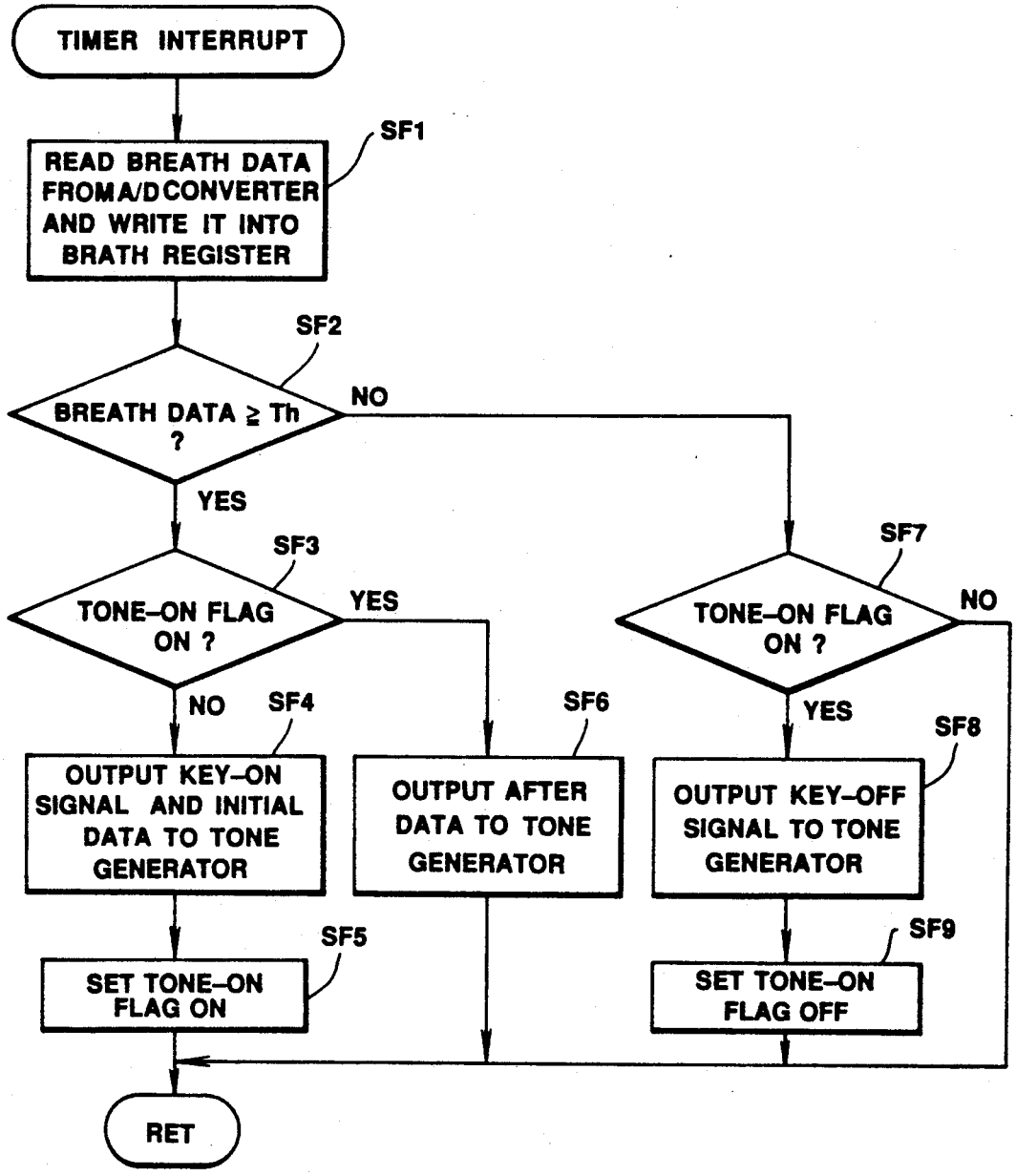
FIG. 17 is a flowchart for explaining a tone generation control process performed by the CPU upon execution of a breath operation.

FIG. 17 illustrates the operation flowchart of the tone generation control process the CPU 6 executes when a breath operation is performed.

When a timer interrupt occurs at a predetermined cycle, the CPU 6 reads breath data corresponding to the breath operation through the A/D converter 10, and writes this data into the BRATH register (not shown) (SF1).

Then, the CPU 6 discriminates whether or not the value in the BRATH register is equal to or greater than a threshold value Th at the start of generation of the key-ON signal (SF2). If it is equal to or greater than the threshold value Th, the CPU 6 discriminates whether or not the tone-ON flag is ON ("1") (SF3). If the tone-ON flag is not ON, i.e., if no tone generation is presently done by the tone generator 7, the key-ON signal and initial data specifying the volume, etc. at the start of tone generation are sent to the tone generator 7 (SF4), and the tone-ON flag is set ON ("1") (SF5).

The initial data is set based on the amount of a change in breath data per unit time, for example.

Upon reception of the key-ON signal through the above operation, the tone generator 7 starts generating a chord or a single tone based on the pitch data of each constituent of the chord or the pitch data of the single tone sent from the CPU 6.

If the tone-ON flag is not ON ("1") in SF3, the CPU 6 prepares after data such as volume data for specifying the volume of a presently generated chord (or single tone) based on the value of the breath data (SF6).

When a player performs a breath operation through the above operation, the volume of the chord or single tone to be generated will be changed in accordance with the strength of the breath operation.

If the value of the breath data i smaller than the threshold value Th of the key-ON signal in SF2, the CPU 6 discriminates whether or not the tone-ON flag is ON ("1") (SF7). If this flag is ON ("1"), the CPU 6 sends the key-OFF signal to the tone generator 7 (SF8) and then sets the flag OFF ("0") (SF9).

Through the above operation, if the value of the breath data becomes smaller than the predetermined threshold value Th of the key-ON signal during generation of a chord or a single tone, the key-OFF data is sent to the tone generator 7, causing the generator 7 to stop the chord or single tone generation.

Although, according to the above embodiment, when the number of the pitch designating switches switched 0 is 1, 2 or 3 in chord mode 2, the major chord, minor chord or seventh chord is set, it is also possible to set other chords associated with the number of operated switches when it is 4 or more. The association between the number of activated switches and the types of chords to be set by the switches need not be limited, but may hold an arbitrary relation. The number of the pitch designating switches is in no way restricted to 7; it can vary as long as the switches can designate pitches in at least a 1-octave range. Further, the root of a chord need not be restricted to fall within the range specified in the above embodiment. The CPU may prepare pitch data of each constituent of a chord through a computation without using any chord conversion table.

In addition, the pitch designating switches are not restricted to be of an ON/OFF type, but may be electrostatic capacitive or pressure-sensitive switches.

As described above, this invention can realize a chord setting apparatus particularly effective in an electronic wind instrument, which has fewer number of pitch designating switches and normally designates a pitch by a combination of operated pitch designating switches, and an electronic wind instrument which facilitates the setting of a chord using this chord setting apparatus.

What is claimed is:

1. A chord setting apparatus comprising:

pitch designating means for designating only one pitch from among pitches in at least one octave range based on a combination of operational statuses of a plurality of pitch designating actuators;

type designating means for designating a type of a chord; and chord setting means for setting a chord of a type designated by said type designating means, with a root being a pitch designated by said pitch designating means.

2. A chord setting apparatus according to claim 1, further comprising:

mode selecting means for selectively switching between a normal mode for setting a single pitch and a chord mode for setting a chord; and control means for setting said pitch designated by said pitch designating means when said normal mode is selected by said mode selecting means and permitting said chord setting means to set a chord when said chord mode is selected by said mode selecting means.

3. An electronic wind instrument comprising:

pitch designating means for designating only one pitch from among pitches in at least one octave range based on a combination of operational statuses of a plurality of pitch designating actuators;

type designating means for designating a type of a chord;

chord setting means for setting a chord of a type designated by said type designating means, with a root being a pitch designated by said pitch designating means; and tone generating means for generating a musical tone associated with said chord set by said chord setting means.

4. An electronic wind instrument comprising:

pitch designating means for designating only one pitch from among pitches in at least one octave range based on a combination of operational statuses of a plurality of pitch designating actuators;

type designating means for designating a type of a chord;

chord setting means for setting a chord of a type designated by said type designating means, with a root being a pitch designated by said pitch designating means; and parameter setting means for setting a value of a parameter for controlling a characteristic of a musical tone to be generated.

5. An electronic wind instrument according to claim 4, further comprising tone generating means for generating said musical tone associated with a chord set by said chord setting means, with a characteristic based on said value of said parameter set by said parameter setting means.

6. An electronic wind instrument according to claim 4, wherein said parameter whose value is set by said parameter setting means determines an octave of a musical tone to be generated.

7. An electronic wind instrument comprising:

pitch designating means for designating only one pitch from among pitches in at least one octave range based on a combination of operational statuses of a plurality of pitch designating actuators;

type designating means for designating a type of a chord;

chord setting means for setting a chord of a type designated by said type designating means, with a root being a pitch designated by said pitch designating means;

mode selecting means for selectively switching between a normal mode for setting a single pitch and a chord mode for setting a chord;

control means for setting said pitch designated by said pitch designating means when said normal mode is selected by said mode selecting means and permitting said chord setting means to set a chord when said chord mode is selected by said mode selecting means; and tone generating means for generating a musical tone associated with said pitch or chord set under control of said control means.

8. An electronic wind instrument comprising:

pitch designating means for designating only one pitch from among pitches in at least one octave range based on a combination of operational statuses of a plurality of pitch designating actuators;

type designating means for designating a type of a chord;

chord setting means for setting a chord of a type designated by said type designating means, with a root being a pitch designated by said pitch designating means;

mode selecting means for selectively switching between a normal mode for setting a single pitch and a chord mode for setting a chord;

control means for setting said pitch designated by said pitch designating means when said normal mode is selected by said mode selecting means and permitting said chord setting means to set a chord when said chord mode is selected by said mode selecting means; and parameter setting means for setting a value of a parameter for controlling a characteristic of a musical tone to be generated.

9. An electronic wind instrument according to claim 8, further comprising tone generating means for generating a musical tone associated with said pitch or chord set under control of said control means, with a characteristic based on said value of said parameter set by said parameter setting means.

10. An electronic wind instrument according to claim 8, wherein said type designating means and said parameter setting means comprise a common operational element which serves as said parameter setting means when said normal mode is selected by said mode selecting means and serves as said type designating means when said chord mode is selected by said mode selecting means.

11. An electronic wind instrument according to claim 8, wherein said parameter whose value is set by said parameter setting means determines an octave of a musical tone to be generated.

12. An electronic wind instrument according to claim 5, wherein said parameter whose value is set by said parameter setting means determines an octave of a musical tone to be generated.

13. An electronic wind instrument according to claim 9, wherein said parameter whose value is set by said parameter setting means determines an octave of a musical tone to be generated.

14. An electronic wind instrument according to claim 9, wherein said type designating means and said parameter setting means comprise a common operational element which serves as said parameter setting means when said normal mode is selected by said mode selecting means and serves as said type designating means when said chord mode is selected by said mode selecting means.

15. An electronic wind instrument according to claim 10, wherein said parameter whose value is set by said parameter setting means determines an octave of a musical tone to be generated.

16. An electronic wind instrument according to claim 14, wherein said parameter whose value is set by said parameter setting means determines an octave of a musical tone to be generated.

17. An electronic wind instrument comprising:

pitch designating means for designating only one pitch from among pitches in at least one octave range based on a combination of operational statuses of a plurality of pitch designating actuators;

type designating means for designating a type of a chord;

chord setting means for setting a chord of a type designated by said type designating means, with a root being a pitch designated by said pitch designating means; and command means for detecting a strength of a breath operation and giving a command to generate a musical tone associated with said chord set by said chord setting means when said strength of said breath operation becomes equal to or greater than a predetermined level.

18. An electronic wind instrument comprising:

pitch designating means for designating only one pitch from among pitches in at least one octave range based on a combination of operational statuses of a plurality of pitch designating actuators;

type designating means for designating a type of a chord;

chord setting means for setting a chord of a type designated by said type designating means, with a root being a pitch designated by said pitch designating means;

mode selecting means for selectively switching between a normal mode for setting a single pitch and a chord mode for setting a chord;

control means for setting said pitch designated by said pitch designating means when said normal mode is selected by said mode selecting means and permitting said chord setting means to set a chord when said chord mode is selected by said mode selecting means; and command means for detecting a strength of a breath operation and giving a command to generate a musical tone associated with said pitch or chord set under control of said control means when said strength of said breath operation becomes equal to or greater than a predetermined level.

19. An electronic wind instrument comprising:

pitch designating means for designating only one pitch from among pitches in at least one octave range based on a combination of operational statuses of a plurality of pitch designating actuators;

type designating means for designating a type of a chord;

chord setting means for setting a chord of a type designated by said type designating means, with a root being a pitch designated by said pitch designating means;

command means for detecting a strength of a breath operation and giving a command to generate a musical tone associated with said chord set by said chord setting means when said strength of said breath operation becomes equal to or greater than a predetermined level; and tone generating means for generating a musical tone in accordance with said command from said command means.

20. An electronic wind instrument comprising:

pitch designating means for designating only one pitch from among pitches in at least one octave range based on a combination of operational statuses of a plurality of pitch designating actuators;

type designating means for designating a type of a chord;

chord setting means for setting a chord of a type designated by said type designating means, with a root being a pitch designated by said pitch designating means;

mode selecting means for selectively switching between a normal mode for setting a single pitch and a chord mode for setting a chord; and control means for setting said pitch designated by said pitch designating means when said normal mode is selected by said mode selecting means and permitting said chord setting means to set a chord when said chord mode is selected by said mode selecting means;

command means for detecting a strength of a breath operation and giving a command to generate a musical tone associated with said pitch or chord set under control of said control means when said strength of said breath operation becomes equal to or greater than a predetermined level; and tone generating means for generating a musical tone in accordance with said command from said command means.

21. An electronic wind instrument comprising:

a plurality of pitch designating actuators respectively assigned with pitches in at least one octave range;

quantity detecting means for, upon operation of said pitch designating actuators, detecting a number of said pitch designating actuators simultaneously operated;

type designating means for designating a type of a chord in accordance with a detection result of said quantity detecting means;

chord setting means for, upon operation of one of said pitch designating actuators, setting a chord of said type designated by said type designating means, with a root being a pitch assigned to said operated pitch designating actuator, and for, upon simultaneous operation of two or more of said pitch designating actuators, setting a chord of said type designated by said type designating means, with a root being a highest or lowest one of those pitches assigned to said operated two or more pitch designating actuators;

command means for detecting a strength of a breath operation and giving a command to generate a musical tone associated with said chord set by said chord setting means when said strength of said breath operation becomes equal to or greater than a predetermined level; and tone generating means for generating a musical tone in accordance with said command from said command means.

22. An electronic wind instrument according to claim 21, wherein upon simultaneous operation of two or more of said pitch designating actuators, said chord setting means sets a chord of said type designated by said type designating means, with a root being a highest one of those pitches assigned to said operated two or more pitch designating actuators.

23. An electronic wind instrument according to claim 21, wherein upon simultaneous operation of two or more of said pitch designating actuators, said chord setting means sets a chord of said type designated by said type designating means, with a root being a lowest one of those pitches assigned to said operated two or more pitch designating actuators.

24. A chord setting apparatus comprising:

a plurality of pitch designating actuators respectively assigned with pitches in at least one octave range;

quantity detecting means for, upon operation of said pitch designating actuators, detecting a number of said pitch designating actuators simultaneously operated;

type designating means for designating a type of a chord in accordance with a detection result of said quantity detecting means; and chord setting means for, upon operation of one of said pitch designating actuators, setting a chord of said type designated by said type designating means, with a root being a pitch assigned to said operated pitch designating actuator, and for, upon simultaneous operation of two or more of said pitch designating actuators, discriminating whether or not those pitches which are assigned to said operated two or more pitch designating actuators have a non-continuous pitch relation, setting a chord of said type designated by said type designating means, with a root being a highest or lowest one of those pitches assigned to said operated two or more pitch designating actuators when it is discriminated that there exists said non-continuous pitch relation, and setting a chord of said type designated by said type designating means when it is not discriminated that said non-continuous relation exists, with a root being that of said highest and lowest pitches which differs from the one taken as said root in a case of where it is discriminated that said non-continuous relation exists.

25. A chord setting apparatus according to claim 24, further comprising:

mode selecting means for selectively switching between a normal mode for setting a single pitch and a chord mode for setting a chord; and control means for setting that pitch assigned to that of said plurality of pitch designating actuators which is operated when said normal mode is selected by said mode selecting means and permitting said chord setting means to set a chord when said chord mode is selected by said mode selecting means.

26. An electronic wind instrument comprising:

a plurality of pinch designating actuators respectively assigned with pitches in at least one octave range;

quantity detecting means for, upon operation of said pitch designating actuators, detecting a number of said pitch designating actuators simultaneously operated;

type designating means for designating a type of a chord in accordance with a detection result of said quantity detecting means;

chord setting means for, upon operation of one of said pitch designating actuators, setting a chord of said type designated by said type designating means, with a root being a pitch assigned to said operated pitch designating actuator, and for, upon simultaneous operation of two or more of said pitch designating actuators, discriminating whether or not those pitches which are assigned to said operated two or more pitch designating actuators have a non-continuous pitch relation, setting a chord of said type designated by said type designating means, with a root being a highest or lowest one of those pitches assigned to said operated two or more pitch designating actuators when it is discriminated that there exists said non-continuous pitch relation, and setting a chord of said type designated by said type designating means when it is not discriminated that said non-continuous relation exists, with a root being that of said highest and lowest pitches which differs from the one taken as said root in a case of where it is discriminated that said non-continuous relation exists; and tone generating means for generating a musical tone associated with said chord set by said chord setting means.

27. An electronic wind instrument comprising:

a plurality of pitch designating actuators respectively assigned with pitches in at least one octave range;

quantity detecting means for, upon operation of said pitch designating actuators, detecting a number of said pitch designating actuators simultaneously operated;

type designating means for designating a type of a chord in accordance with a detection result of said quantity detecting means;

chord setting means for, upon operation of one of said itch designating actuators, setting a chord of said type designated by said type designating means, with a root being a pitch assigned to said operated pitch designating actuator, and for, upon simultaneous operation of two or more of said pitch designating actuators, discriminating whether or not those pitches which are assigned to said operated two or more pitch designating actuators have a non-continuous pitch relation, setting a chord of said type designated by said type designating means, with a root being a highest or lowest one of those pitches assigned to said operated two or more pitch designating actuators when it is discriminated that there exists said non-continuous pitch relation, and setting a chord of said type designated by said type designating means when it is not discriminated that said non-continuous means when it is not discriminated that said non-continuous relation exists, with a root being that of said highest and lowest pitches which differs from the one taken as said root in a case of where it is discriminated that said non-continuous relation exists;

mode selecting means for selectively switching between a normal mode for setting a single pitch and a chord mode for setting a chord;

control means for setting that pitch assigned to that of said plurality of pitch designating actuators which is operated when said normal mode is selected by said mode selecting means and permitting said chord setting means to set a chord when said chord mode is selected by said mode selecting means; and tone generating means for generating a musical tone associated with said pitch or chord set under control of said control means.

28. An electronic wind instrument comprising:

a plurality of pitch designating actuators respectively assigned with pitches in at least one octave range;

quantity detecting means for, upon operation of said pitch designating actuators, detecting a number of said pitch designating actuators simultaneously operated;

type designating means for designating a type of a chord in accordance with a detection result of said quantity detecting means;

chord setting means for, upon operation of one of said pitch designating actuators, setting a chord of said type designated by said type designating means, with a root being a pitch assigned to said operated pitch designating actuator, and for, upon simultaneous operation of two or more of said pitch designating actuators, discriminating whether or not those pitches which are assigned to said operated two or more pitch designating actuators have a non-continuous pitch relation, setting a chord of said type designated by said type designating means, with a root being a highest or lowest one of those pitches assigned to said operated two or more pitch designating actuators when it is discriminated that there exists said non-continuous pitch relation, and setting a chord of said type designated by said type designating means when it is not discriminated that said non-continuous relation exists, with a root being that of said highest and lowest pitches which differs from the one taken as said root in a case of where it is discriminated that said non-continuous relation exists; and command means for detecting a strength of a breath operation and giving a command to generate a musical tone associated with said chord set by said chord setting means when said strength of said breath operation becomes equal to or greater than a predetermined level.

29. An electronic wind instrument comprising:

a plurality of pitch designating actuators respectively assigned with pitches in at least one octave range;

quantity detecting means for, upon operation of said pitch designating actuators, detecting a number of said pitch designating actuators simultaneously operated;

type designating means for designating a type of a chord in accordance with a detection result of said quantity detecting means;

chord setting means for, upon operation of one of said pitch designating actuators, setting a chord of said type designated by said type designating means, with a root being a pitch assigned to said operated pitch designating actuator, and for, upon simultaneous operation of two or more of said pitch designating actuators, discriminating whether or not those pitches which are assigned to said operated two or more pitch designating actuators, have a non-continuous pitch relation, setting a chord of said type designated by said type designating means, with a root being a highest or lowest one of those pitches assigned to said operated two or more pitch designating actuators when it is discriminated that there exists said non-continuous pitch relation, and setting a chord of said type designated by said type designating means when it is not discriminated that said non-continuous relation exists, with a root being that of said highest and lowest pitches which differs from the one taken as said root in a case of where it is discriminated that said non-continuous relation exists;

mode selecting means for selectively switching between a normal mode for setting a single pitch and a chord mode for setting a chord;

control means for setting that pitch assigned to that of said plurality of pitch designating actuators which is operated when said normal mode is selected by said mode selecting means and permitting said chord setting means to set a chord when said chord mode is selected by said mode selecting means; and command means for detecting a strength of a breath operation and giving a command to generate a musical tone associated with said pitch or chord set by said chord setting means when said strength of said breath operation becomes equal to or greater than a predetermined level.

30. An electronic wind instrument comprising:

a plurality of pitch designating actuators respectively assigned with pitches in at least one octave range;

quantity detecting means for, upon operation of said pitch designating actuators, detecting a number of said pitch designating actuators simultaneously operated;

type designating means for designating a type of a chord in accordance with a detection result of said quantity detecting means;

chord setting means for, upon operation of one of said pitch designating actuators, setting a chord of said type designated by said type designating means, with a root being a pitch assigned to said operated pitch designating actuator, and for, upon simultaneous operation of two or more of said pitch designating actuators, discriminating whether or not those itches which are assigned to said operated two or more pitch designating actuators have a non-continuous pitch relation, setting a chord of said type designated by said type designating means, with a root being a highest or lowest one of those pitches assigned to said operated two or more pitch designating actuators when it is discriminated that there exists said non-continuous pitch relation, and setting a chord of said type designated by said type designating means when it is not discriminated that said non-continuous relation exists, with a root being that of said highest and lowest pitches which differs from the one taken as said root in a case of where it is discriminated that said non-continuous relation exists;

command means for detecting a strength of a breath operation and giving a command to generate a musical tone associated with said chord set by said chord setting means when said strength of said breath operation becomes equal to or greater than a predetermined level; and tone generating means for generating a musical tone in accordance with said command from said command means.

31. An electronic wind instrument comprising:

a plurality of pitch designating actuators respectively assigned with pitches in at least one octave range;

quantity detecting means for, upon operation of said pitch designating actuators, detecting a number of said pitch designating actuators simultaneously operated;

type designating means for designating a type of a chord in accordance with a detection result of said quantity detecting means;

chord setting means for, upon operation of one of said pitch designating actuators, setting a chord of said type designated by said type designating means, with a root being a pitch assigned to said operated pitch designating actuator, and for, upon simultaneous operation of two or more of said pitch designating actuators, discriminating whether or not those pitches which are assigned to said operated two or more pitch designating actuators have a non-continuous pitch relation, setting a chord of said type designated by said type designating means, with a root being a highest or lowest one of those pitches assigned to said operated two or more pitch designating actuators when it is discriminated that there exists said non-continuous pitch relation, and setting a chord of said type designated by said type designating means when it is not discriminated that said non-continuous relation exists, with a root being that of said highest and lowest pitches which differs from the one taken as said root in a case of where it is discriminated that said non-continuous relation exists;

mode selecting means for selectively switching between a normal mode for setting a single pitch and a chord mode for setting a chord;

control means for setting that pitch assigned to that of said plurality of pitch designating actuators which is operated when said normal mode is selected by said mode selecting means and permitting said chord setting means to set a chord when said chord mode is selected by said mode selecting means;

command means for detecting a strength of a breath operation and giving a command to generate a musical tone associated with said pitch or chord set by said chord setting means when said strength of said breath operation becomes equal to or greater than a predetermined level; and tone generating means for generating a musical tone in accordance with said command from said command means.

* * * * *

UNITED STATES PATENT AND TRADEMARK OFFICE

CERTIFICATE OF CORRECTION

PATENT NO. : 5,014,586

DATED : May 14, 1991

INVENTOR(S) : Shigeo SAKASHITA

It is certified that error appears in the above-identified patent and that said Letters Patent is hereby corrected as shown below:

In the title page, under Section [56] References Cited, insert the following references:

U.S. PATENT DOCUMENTS -

| | | | |
|---|---|---|---|
| 2,138,500 | 11/1938 | Miessner et al. | 84/1 |
| 2,301,184 | 11/1942 | Arnold | 84/1.01 |
| 3,429,976 | 2/1969 | Tomcik | 84/1.12 |
| 3,439,106 | 4/1969 | Goodale | 84/1.27 |
| 3,767,833 | 10/1973 | Noble et al. | 84/1.01 |
| 3,938,419 | 2/1976 | De Rosa | 84/1.14 |
| 4,065,993 | 1/1978 | Hirose | 84/DIG.22X |
| 4,085,646 | 4/1978 | Naumann | 84/1.09 |
| 4,151,368 | 4/1979 | Fricke et al. | 84/1.01 |
| 4,168,645 | 9/1979 | Squire et al. | 84/1.01 |
| 4,178,821 | 12/1079 | Gallina et al. | 84/1.01 |
| 4,274,321 | 6/1981 | Swartz | 84/1.03 |
| 4,353,278 | 10/1982 | Adachi et al. | 84/1.01 |
| 4,418,599 | 12/1983 | Raskin | 84/1.13 |
| 4,499,807 | 2/1985 | Ishida | 84/1.03 |
| 4,757,737 | 7/1988 | Conti | 84/1.12 |
| 4,915,008 | 4/1990 | Sakashita | 84/658 |
| 4,919,032 | 4/1990 | Sakashita | 84/653 |

FOREIGN PATENT DOCUMENTS -

| | | |
|---|---|---|
| 63-128596 | 8/1988 | Japan |
| 63-210893 | 9/1988 | Japan |

UNITED STATES PATENT AND TRADEMARK OFFICE

CERTIFICATE OF CORRECTION

PATENT NO. : 5,014,586

DATED : May 14, 1991

INVENTOR(S) : Shigeo SAKASHITA

It is certified that error appears in the above-identified patent and that said Letters Patent is hereby corrected as shown below:

OTHER DOCUMENTS -

YAMAHA WX-7 (excerpt of an operation manual)
YAMAHA WX-11 (excerpt of an operation manual)
AKAI EWV 2000 (excerpt of an operation manual)

Signed and Sealed this

Twenty-fifth Day of May, 1993

*Attest:*

Michael K. Kirk

MICHAEL K. KIRK

*Attesting Officer*

*Acting Commissioner of Patents and Trademarks*